US008181712B2

(12) United States Patent
Liu

(10) Patent No.: US 8,181,712 B2
(45) Date of Patent: May 22, 2012

(54) NOSE PIECE FOR INSERTING FIXING ELEMENTS INTO PREDEFINED SEATS

(75) Inventor: Sung Hsiang Liu, Scarborough (CA)

(73) Assignee: Sigma Tool & Machine, Ontario (CA)

( * ) Notice: Subject to any disclaimer, the term of this patent is extended or adjusted under 35 U.S.C. 154(b) by 395 days.

(21) Appl. No.: 12/390,266

(22) Filed: Feb. 20, 2009

(65) Prior Publication Data

US 2010/0213233 A1 Aug. 26, 2010

(51) Int. Cl.
*B25C 7/00* (2006.01)

(52) U.S. Cl. ..... 173/1; 227/17; 227/15; 227/131

(58) Field of Classification Search ..... 227/15, 227/17, 18, 108, 109, 120, 131; 173/1
See application file for complete search history.

(56) References Cited

U.S. PATENT DOCUMENTS

| | | | | |
|---|---|---|---|---|
| 1,726,012 | A * | 8/1929 | Bilz | 227/147 |
| 2,706,506 | A * | 4/1955 | Wagner | 81/453 |
| 3,157,884 | A * | 11/1964 | Decot et al. | 227/136 |
| 3,438,449 | A | 4/1969 | Smith | |
| 3,452,637 | A * | 7/1969 | O'Brien | 411/439 |
| 3,460,217 | A | 8/1969 | Leistner | |
| 3,480,061 | A | 11/1969 | Leistner | |
| 3,658,229 | A | 4/1972 | Pomeroy | |
| 3,826,419 | A * | 7/1974 | Maestri | 227/136 |
| 3,964,659 | A | 6/1976 | Eiben et al. | |
| 4,049,181 | A | 9/1977 | Kametaki | |
| 4,062,388 | A * | 12/1977 | DeCaro | 81/57.37 |
| 4,251,017 | A | 2/1981 | Doyle et al. | |
| 4,389,012 | A | 6/1983 | Grikis et al. | |
| 4,463,888 | A | 8/1984 | Geist et al. | |
| 4,558,811 | A | 12/1985 | Klaus | |
| 4,809,900 | A | 3/1989 | Ingelsten et al. | |

(Continued)

FOREIGN PATENT DOCUMENTS

EP 0894578 2/1999

(Continued)

OTHER PUBLICATIONS

Stanley Bostitch, www.bostitch.com, PN100K-Industrial Impact Nailer Kit.

(Continued)

*Primary Examiner* — Paul Durand
(74) *Attorney, Agent, or Firm* — Birch, Stewart, Kolasch & Birch, LLP

(57) ABSTRACT

A nose piece for inserting fixing elements into predefined seats in a work piece includes a drive channel for receiving a lower end of a drive rod. The drive rod is movable from an initial upper position, through a first intermediate position, to a lower position when acted on from above on by a drive force. A lower face of the nose piece is adapted to receive a first fixing element. At least one finger is biased toward a side wall of the nose piece. When the drive rod exerts a force on an actuator, the actuator moves the finger from a closed position, in which a lower portion of the finger is disposed under an outer portion of the flange of the first fixing element, to an open position, in which the lower portion of the finger is disposed away from under the outer portion of the flange of the first fixing element.

39 Claims, 25 Drawing Sheets

U.S. PATENT DOCUMENTS

| | | | | |
|---|---|---|---|---|
| 5,025,968 | A | 6/1991 | Nasiatka | |
| 5,192,012 | A | 3/1993 | Schafer et al. | |
| 5,231,750 | A | 8/1993 | Fealey | |
| 5,385,286 | A | 1/1995 | Johnson, Jr. | |
| 5,452,835 | A * | 9/1995 | Shkolnikov | 227/8 |
| 5,484,094 | A | 1/1996 | Gupta | |
| 5,579,975 | A | 12/1996 | Moorman | |
| 5,803,338 | A | 9/1998 | Singer et al. | |
| 5,810,239 | A * | 9/1998 | Stich | 227/119 |
| 5,842,625 | A | 12/1998 | Kimura | |
| 6,041,992 | A * | 3/2000 | Poinelli et al. | 227/130 |
| 6,199,739 | B1 | 3/2001 | Mukoyama et al. | |
| 6,422,447 | B1 | 7/2002 | White et al. | |
| D462,589 | S | 9/2002 | Nolan et al. | |
| 6,443,348 | B2 | 9/2002 | Lamb | |
| 6,481,611 | B2 * | 11/2002 | Losada | 227/119 |
| 6,578,749 | B1 * | 6/2003 | Shen et al. | 227/119 |
| 6,708,861 | B2 | 3/2004 | Osuga et al. | |
| 6,761,299 | B2 | 7/2004 | Caringella et al. | |
| 6,789,718 | B2 * | 9/2004 | Canlas et al. | 227/130 |
| 7,111,767 | B2 * | 9/2006 | Losada | 227/119 |
| 2004/0188490 | A1 | 9/2004 | Losada | |
| 2007/0114259 | A1 * | 5/2007 | Bromley et al. | 227/120 |
| 2008/0277446 | A1 * | 11/2008 | Yamamoto et al. | 227/139 |
| 2009/0166393 | A1 * | 7/2009 | Gross et al. | 227/131 |

FOREIGN PATENT DOCUMENTS

| | | | |
|---|---|---|---|
| WO | WO-2006/066589 | A2 | 6/2006 |

OTHER PUBLICATIONS

Sigma Tool & Machine, Sigma Hand Held T-Nut Tool.
Pneu Tools, Rap-A-Nail 150, Collated Joist Hanger Nailer.
www.Sigmatool.com/t-nut-machines/handheld-t-nut-tool.html.
BeA Italiana Fissatrice BF 700-C-5/6.

* cited by examiner

NOSE PIECE FOR INSERTING FIXING ELEMENTS INTO PREDEFINED SEATS

BACKGROUND OF THE INVENTION

1. Field of the Invention

The invention relates generally to an apparatus for inserting fixing elements into a work piece.

2. Description of Background Art

Conventional devices for inserting a fixing element into a work piece typically include a nose piece with fixing elements held under a lower end of a drive rod penetrating through the nose piece. One approach for holding the fixing elements 100 in position under the nose piece 450 involves equipping the device with one or more spring-loaded fingers 459 with portions that extend under the outer portions 110*o* of the flange 110 of the fixing element 100. Portions of the fingers 459 extending under the outer portions 110*o* of the flange 110 hold the fixing element 100 in position under the drive rod 20. In addition to spring-loaded fingers 459, a magnet may be provided in the nose piece to hold the fixing element in position below the drive rod. In devices equipped with spring loaded fingers. When the drive rod moves downwardly and reaches the upper surface of the fixing element, the fingers holding the fixing element are forced open by the impact of the drive rod on the fixing element.

FIG. 16 is a perspective view of device with a conventional nose piece 450 with angled fingers 459 that do not open prior to driving the fixing element 100 into the work piece. FIG. 17 is a cut-away view of the conventional device of FIG. 16, having a nose piece 450 with angled fingers 459 that do not open prior to driving the fixing element 100 into the work piece. FIG. 18 is another perspective view of the conventional device of FIG. 16, having a nose piece 450 with angled fingers that do not open prior to driving the fixing element 100 into the work piece.

Conventional devices have employed spring-loaded fingers extending horizontally under the flanges, and also spring-loaded fingers 459 (such as those shown in FIGS. 16-18) that are angled at approximately 45°. While fingers angled at 45° reduce the force on the flanges, compared to fingers extending horizontally, flange distortion and spring breakage remain a problem. Moreover, spring-loaded fingers 459 that are angled at approximately 45° fail to provide sufficient guidance when the fixing element 100 is transferred from a feed track 60 to the position under the nose piece 450.

As speed of the drive rod 20 increases, the speed of opening of the fingers 459 leads to frequent spring breakage. As the speed of the drive rod 20 increases still further, the at least outer portions of the flange of the fixing element 100 are not able to withstand the very rapid application of force to open the fingers 459, and the flange 110 is often bent and distorted during insertion.

To make a lightweight portable device or hand tool (or standalone machine) for inserting fixing elements, the speed of the drive rod must be very fast in order provide enough force to drive the fixing element into the work piece. At high speeds, the problems described above make the conventional finger arrangement unworkable.

SUMMARY OF THE INVENTION

According to an embodiment of the present invention, an apparatus is provided for inserting fixing elements into predefined seats in a work piece, and includes a drive rod that is movable in an axial direction from an initial upper position, through a first intermediate position, and to a lower position when acted upon by a drive force exerted from above; a nose piece having a central drive channel adapted to receive a lower end of the drive rod, and a lower face that is adapted to receive a first fixing element; and at least one finger biased toward a side wall of the nose piece. When the drive rod moves through the first intermediate position, a force from the drive rod is exerted on an actuator, and the actuator moves the finger from a closed position, in which a lower portion of the finger is disposed under an outer portion of the flange of the first fixing element, to an open position, in which the lower portion of the finger is disposed away from under the outer portion of the flange of the first fixing element.

According to an alternative embodiment of the present invention, a nose piece is provided for inserting fixing elements into predefined seats in a work piece and includes a drive channel extending along a vertical axis of the nose piece, the drive channel being adapted to receive a lower end of a drive rod, the drive rod being movable from an initial upper position, through a first intermediate position, and to a lower position when acted on from above on by a drive force; and a lower face of the nose piece adapted to receive a first fixing element. The nose piece also includes a side wall of the nose piece toward which at least one finger is biased. When the drive rod moves through the first intermediate position, a force from the drive rod is exerted on an actuator, and the actuator moves the finger from a closed position, in which a lower portion of the finger is disposed under an outer portion of the flange of the first fixing element, to an open position, in which the lower portion of the finger is disposed away from under the outer portion of the flange of the first fixing element.

According to an alternative embodiment of the present invention, a method is provided for inserting a fixing element into each of at least one predefined seat of a work piece. The method includes providing a first fixing element at a lower face of a nose piece in a position facing a first end of a drive rod; the first end of the drive rod being received in a drive channel of the nose piece; the drive rod receiving a downward drive force on a second end thereof; the drive force moving the drive rod from an initial upper position, through a first intermediate position, and toward a lower position; the drive rod exerting a force on an actuator while moving through the first intermediate position, the actuator exerting a force on at least one finger, which is biased toward a side wall of the nose piece. As a result, the finger is moved from a closed position in which a lower portion of the finger is disposed under an outer portion of the flange of the first fixing element, to an open position in which the lower portion of the finger is moved away from under the outer portion of the flange of the first fixing element, and upon reaching the lower position, the downward drive force on the drive rod inserting the first fixing element into a first predefined seat of the work piece.

Further scope of applicability of the apparatus discussed herein will become apparent from the detailed description given hereinafter. However, it should be understood that the detailed description and specific examples, while indicating exemplary embodiments of the invention, are given by way of illustration only, since various changes and modifications within the spirit and scope of the invention will become apparent to those skilled in the art from this detailed description.

BRIEF DESCRIPTION OF THE DRAWINGS

The invention will become more fully understood from the detailed description given hereinbelow and the accompanying drawings which are given by way of illustration only, and thus are not limitative of the invention, and wherein:

FIG. 2(*b*) is an exploded drawing of the portable device and drive head consistent with some embodiments of the present invention;

FIGS. 9(*d*) to 9(*f*) are cut-away views showing an exemplary sequence of a standalone machine inserting a fixing element into a hole of the work piece when the work piece is located at a distance from the nose piece, consistent with some embodiments of the present invention;

DETAILED DESCRIPTION

Figure 1:
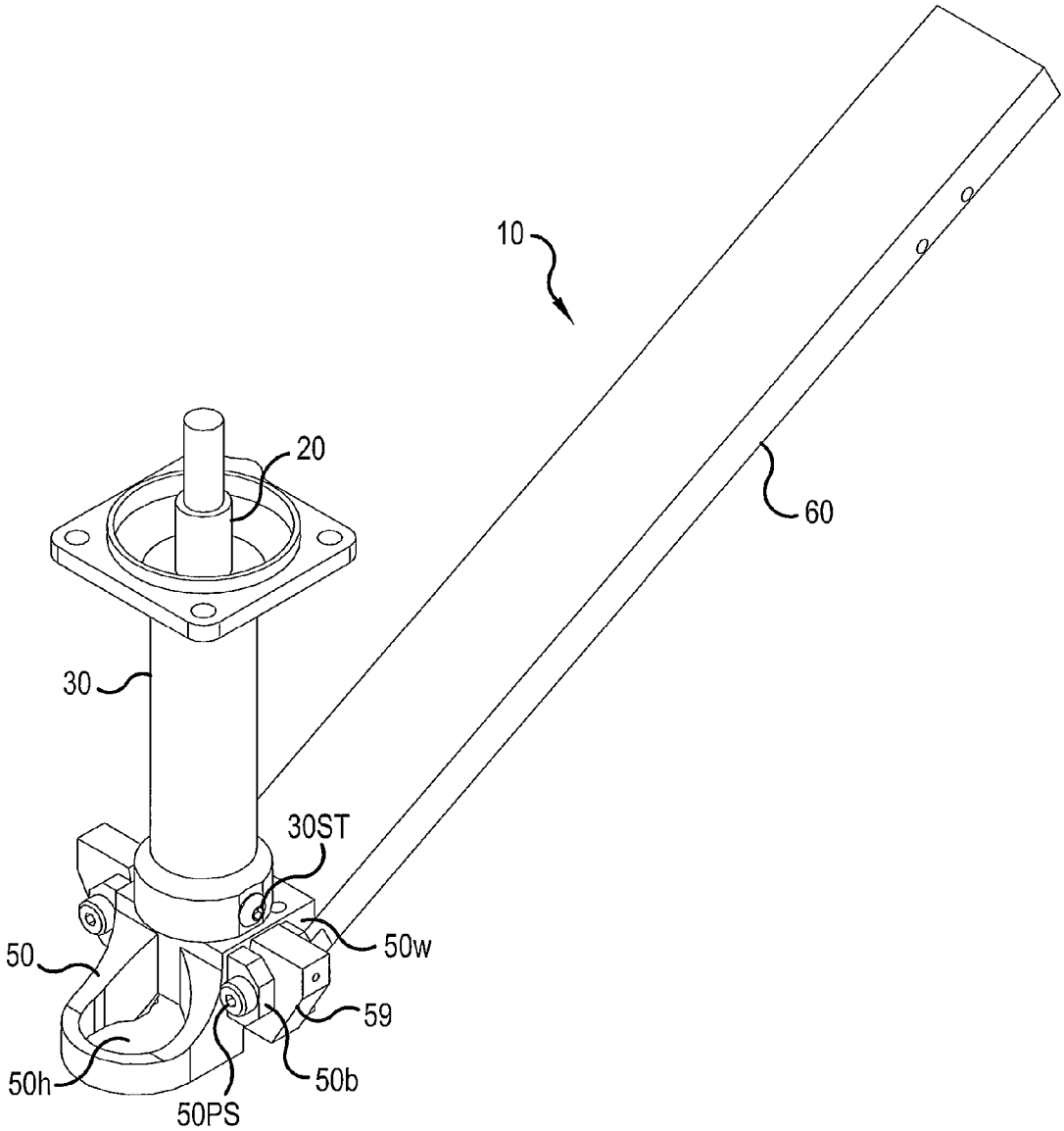
FIG. 1 is a drawing of an nose piece of a portable device for inserting fixing elements consistent with some embodiments of the present invention.
Figure 2A:
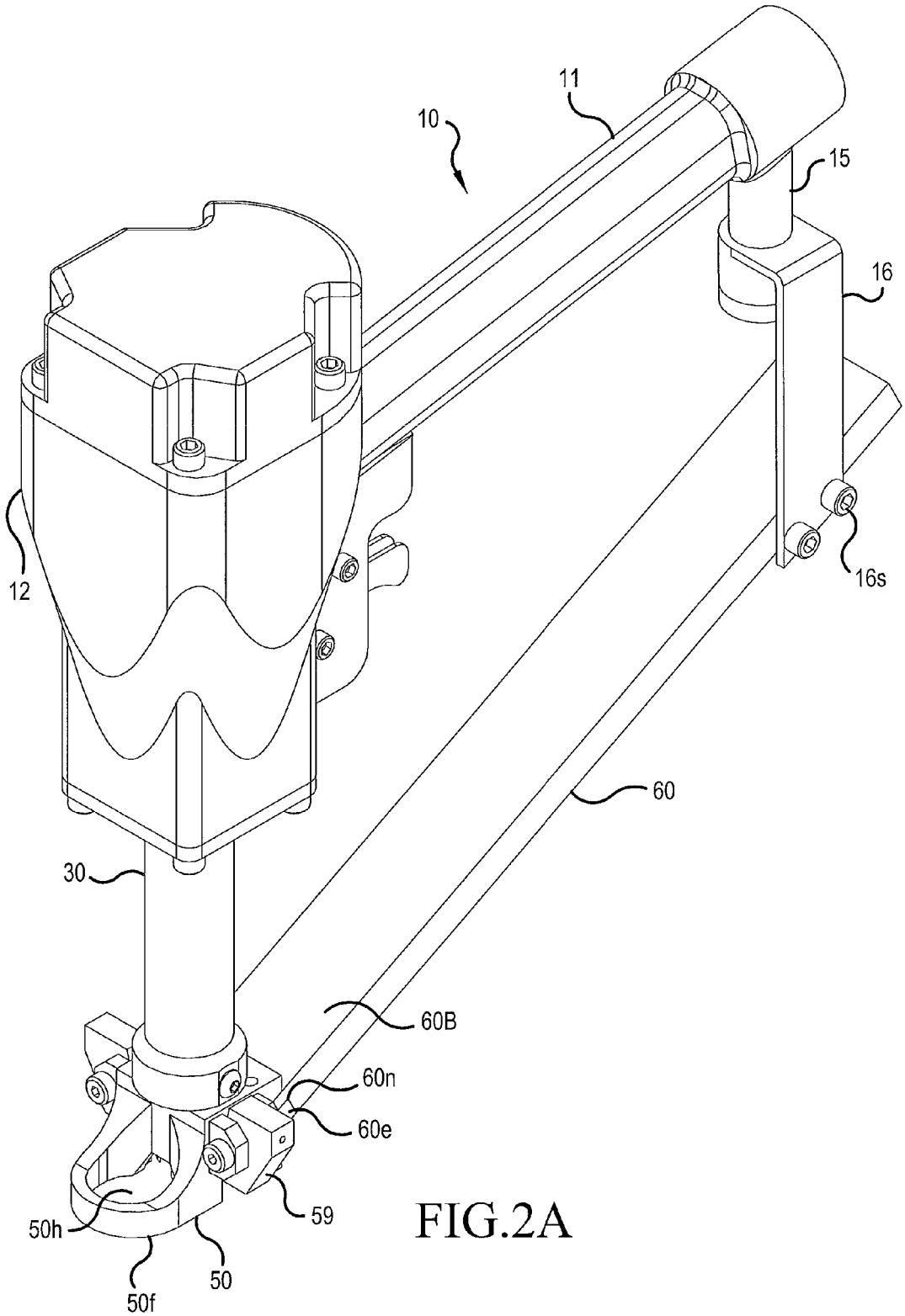
FIG. 2(*a*) is a drawing of the portable device of FIG. 1 including a drive head, consistent with some embodiments of the present invention.
Figure 2B:
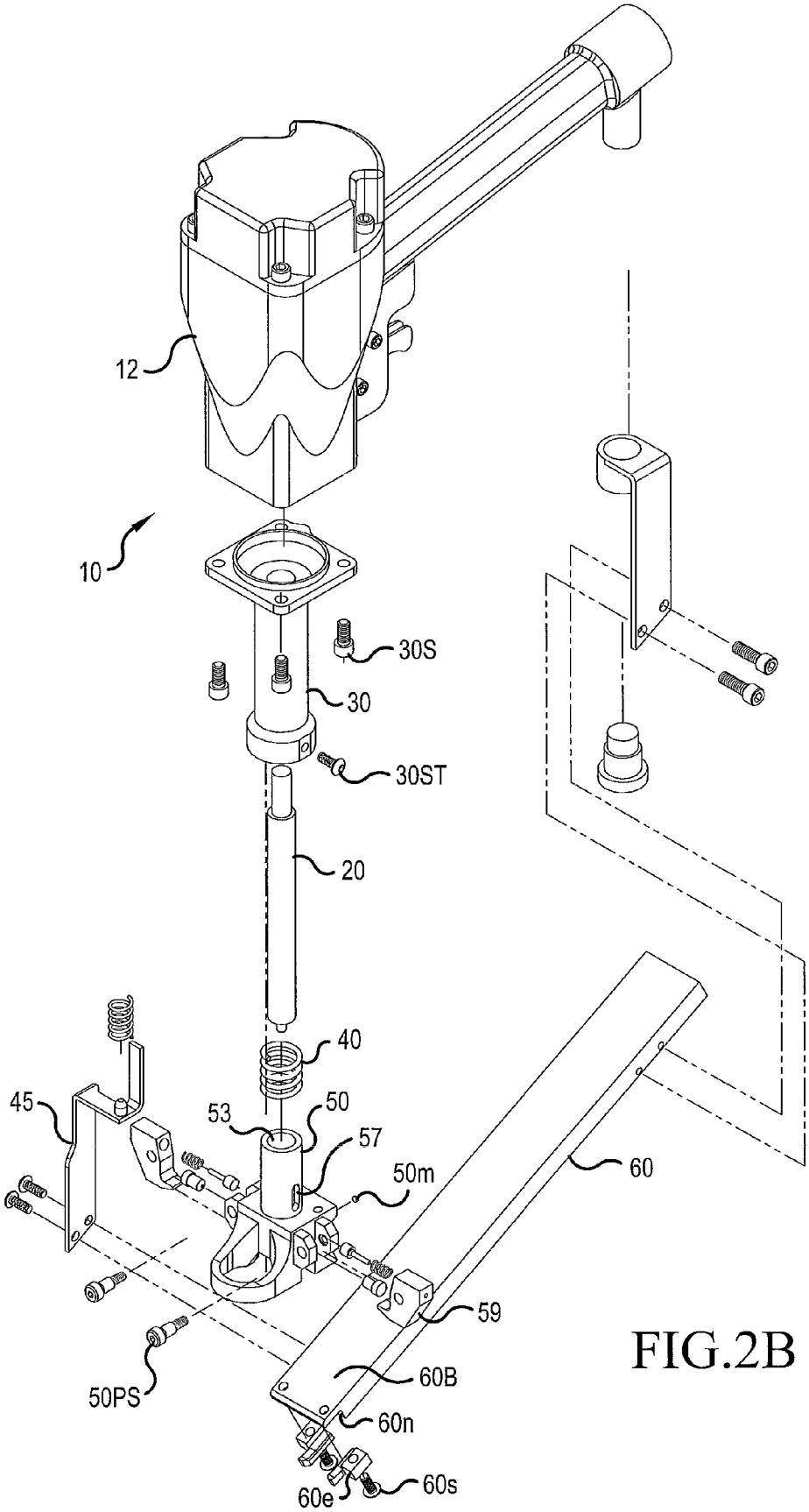
Figure 3:
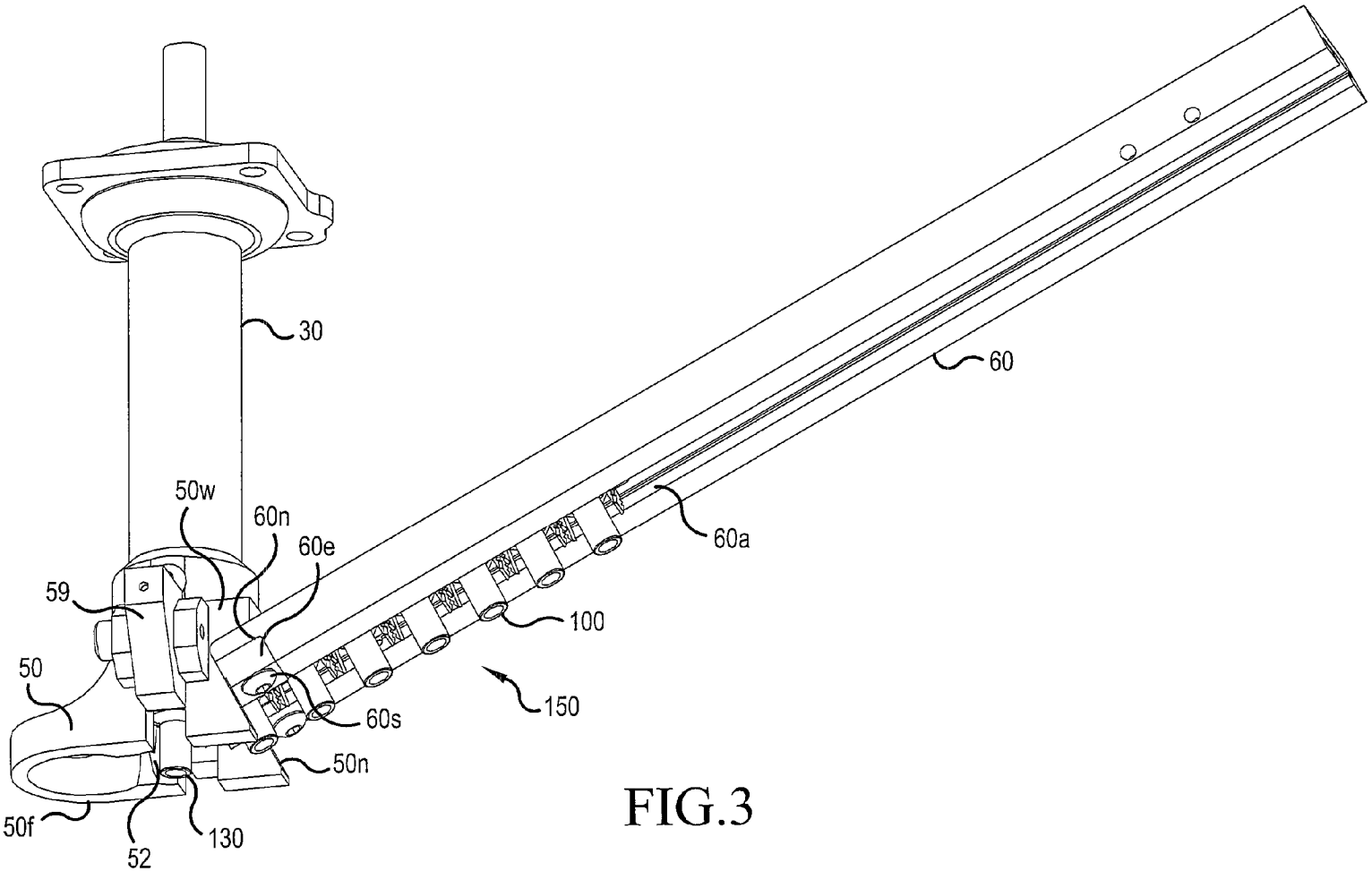
FIG. 3 is a perspective view of the portable device, with fixing elements in a feed track.
Figure 4A:
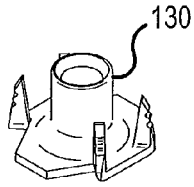
FIGS. 4(*a*) to 4(*h*) illustrate views of an exemplary individual fixing element and a strip of fixing elements.
Figure 4B:
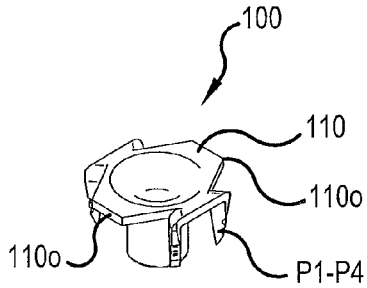
Figure 4C:
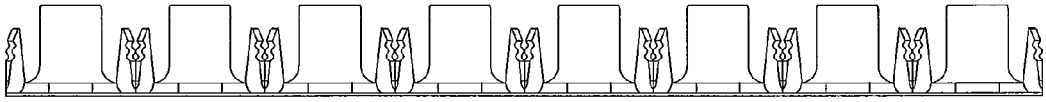
Figure 4D:
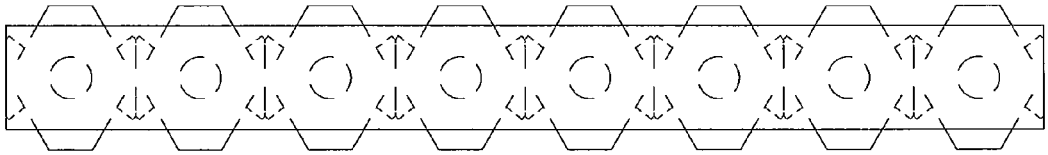
Figure 4E:
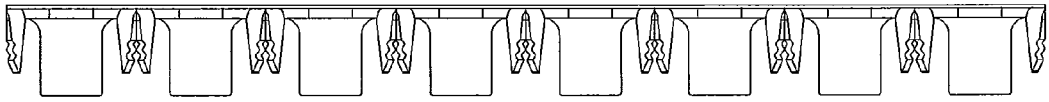
Figure 4F:
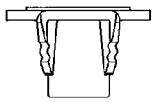
Figure 4G:
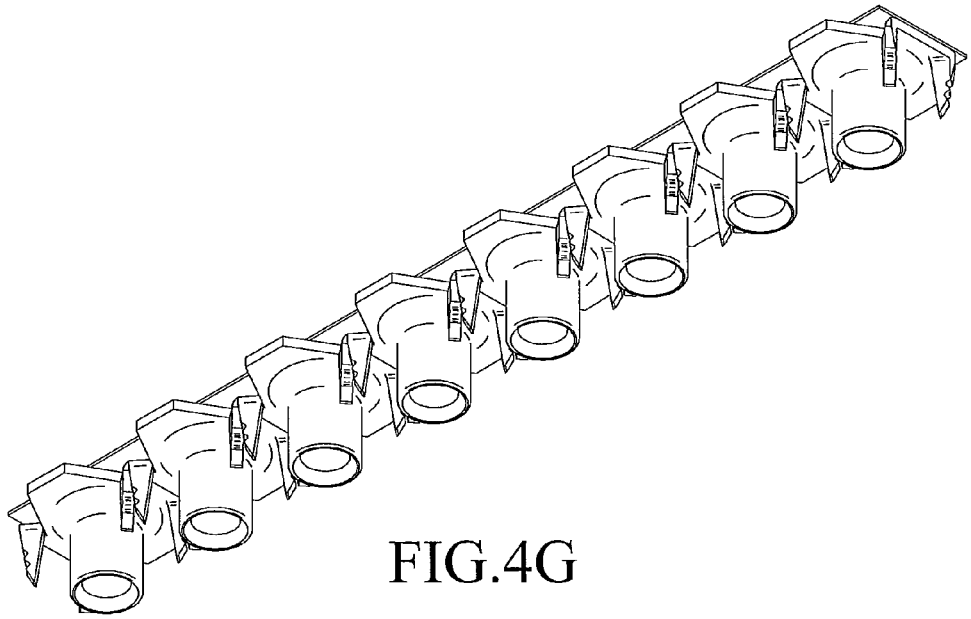
Figure 4H:
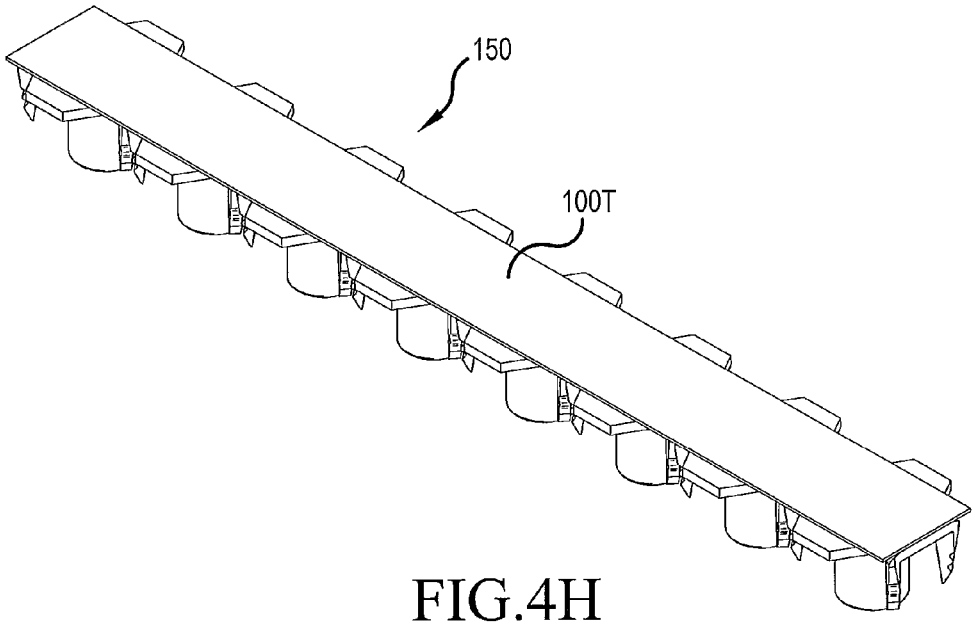

FIGS. 1, 2(*a*), 2(*b*), and 3 illustrate a portable device 10 with a nose piece 50 having a pair of-pivotable fingers 59, a feed track 60 fitted into a notch 50*n* of the nose piece 50 for feeding fixing elements 100 into a horizontal slot 52 formed on the lower face 50*f* of the nose piece 50. Drive rod 20 extends downward from the drive head 12 and penetrates through guide tube 30 and extends into the drive channel 53 (See FIG. 3) of the nose piece 50. When an operator uses the device 10 to drive a fixing element 100 into a seat of a work piece, the drive head 12 exerts a force on the upper end of the drive rod 20, driving the drive rod 20 downwardly against the fixing element 100, and thereby driving the fixing element 100 into the seat. This operation is illustrated, for example, in FIGS. 8(*a*) to *c*).

As can be seen in FIGS. 1, 2(*a*), 2(*b*), and 3, the end of the feed track 60 includes a notch 60*n*. The feed track 60 is mounted onto the nose piece 50 by a fastner 60*s* passing through each of a pair of track end pieces 60*e* and secured into an upper portion of the notch 50*n* of the nose piece 50. Pivotable fingers 59 are mounted on opposite outer side walls 50W of nose piece 50. Each of the pivotable fingers 59 is held in place by a pivot shaft 50PS extending between a pair of bosses 50*b* projecting from each of the two opposite side walls 50W.

FIG. 2(*a*) is a perspective view of portable device 10 illustrating drive head 12, an upper portion of the guide tube 30 fixed to the drive head 12, gripping handle 11, shaft 15, and a holding bracket 16 which is fastened to the feed track 60 by a pair of fasteners 16*s*. The lower face 50*f* of the nose piece 50 extends in a forward direction with respect to the feed track 60, thereby providing the lower face 50*f* with an enlarged surface area. When the nose piece 50 is placed upon a work piece, the enlarged surface area of the lower face 50*f* assists the operator of the device to make sure that the nose piece 50 rests firmly upon the work piece, with an axis of the nose piece extending orthogonally to the surface of the work piece. Viewing hole 50 is an viewing opening on the nose piece 50 to assist the operator of the portable device 10 in finding the predetermined seats in the work piece into which the fixing elements 100 are to be inserted.

The exploded view of FIG. 2(*b*) illustrates fasteners 30*s* for mounting the guide tube 30 onto the drive head 12. An upper end of the drive rod 20 fits into a bore 30*b* of the guide tube 30, and a lower end of the drive rod 20 is received in the drive channel 53 of the nose piece 50. Nose piece 50 is biased downwardly with respect to the guide tube by one or more springs 40. The nose piece 50 includes a vertical slot 57 through which stopper 30ST is provided on the and secured into a hole of the guide tube 30. The stopper 30ST enables the nose piece to be movable vertically with respect to the guide tube and the drive head by a distance equal to the length of the vertical slot 57. FIG. 2(*b*) also illustrates magnet 50*m* which assists in holding each of the fixing elements in the horizontal slot 52. (See also, FIGS. 6(*a*) and 6(*g*).)

Safety mechanism 45 mounted adjacent to the nose piece 50 prevents a drive force from being exerted to the upper end of the drive rod 20 until after the nose piece 50 is moved upwardly. Thus, only when an operator of the portable device 10 places the nose piece 50 against the work piece and applies a downward pressure on the device, causing the nose piece 50 and safety mechanism 45 to move upwardly toward a drive head 12 by an amount equivalent to the length of the vertical slot 57, does the device 10 allow the drive force to be applied to the upper end of the drive rod 20 in order to drive the fixing element 100 into the seat.

FIGS. 2(*a*), 2(*b*), and 3 illustrate how the feed track 60 may be connected to the nose piece 50. As can be seen, a downstream end 60B of the feed track 60 includes a notch 60*n* and a feed track end piece 60*e* positioned in the notch 60*n*. A fastener 60*s* penetrates through each of the end pieces 60*e* and the downstream end 60B, in order to secure the feed track 60 into the notch 50*n* of the nose piece 50.

FIGS. 4(*a*) to 4(*h*) provide views of an exemplary individual fixing element 100 and a fixing element strip 150. FIGS. 4(*a*) and 4(*b*) show perspective views of an individual fixing element 100. As can be seen, the fixing element 100 includes a barrel 130, a flange 110 having an outer portion 110*o*, and one or more prongs P1 to P4. FIGS. 4(*c*) to 4(*h*) show a strip 150 of fixing elements 100 collated and held in place by a strip of tape 100T. FIGS. 4(*c*) and 4(*e*) are side views, FIG. 4(*d*) is a plan view, FIG. 4(*f*) is an end view, and FIGS. 4(*g*) and (*h*) are perspective views of the strip 150 of fixing elements 100. The device of the invention may accommodate fixing elements having various base sizes, for example, a small base: 0.625"×0.700", a large base: 0.830"× 0.885", or other sizes smaller or greater than these. Also, the device of the invention may accommodate various types of fixing elements, including any fastener having a flange. These may include nails and threaded fasteners for insertion into a work piece with or without predefined seats, and fasteners with hollow or closed barrels, with or without prongs, and with or without barrels having threaded portions.

The tape 100T is formed with adhesive on the side applied to the bottom of the fixing elements 100. Any commonly known material may be used for the adhesive tape 100T. Once the fixing elements 100 are collated into a strip 150, the strip 150 is ready to be inserted into the feed track (for example, magazine) 60.

In the portable device 10, the nose piece/magazine combination is attached to the drive head 12 in such a way that the feed track (for example, magazine) 60 and nose piece 50 may slide up and down along a guide tube 30 which is mounted by screws 30*s* on the bottom of the drive head 12. A mechanism prevents the nose piece/magazine from falling off the guide tube 30. In some embodiments, the mechanism may include a vertical slot 57 machined into a side of the nose piece 50 through which a screw 50*s* is fastened to the extension tube 30. The nose piece 50 is able to slide up and down the extension tube 30 only over the length of the slot 57. One or more springs 40 (See FIG. 2) may be fitted between the nose piece 50 and the guide tube 30, in order to bias the nose piece 50 away from the drive head 12.

Figure 5A:
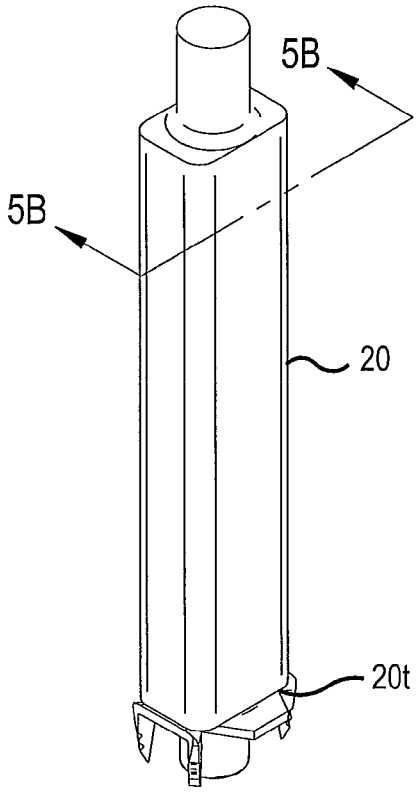
FIGS. 5(*a*) to 5(*c*) illustrate a perspective view, a side view, and a sectional view of a drive rod of the portable apparatus consistent with some embodiments of the present invention.
Figure 5B:
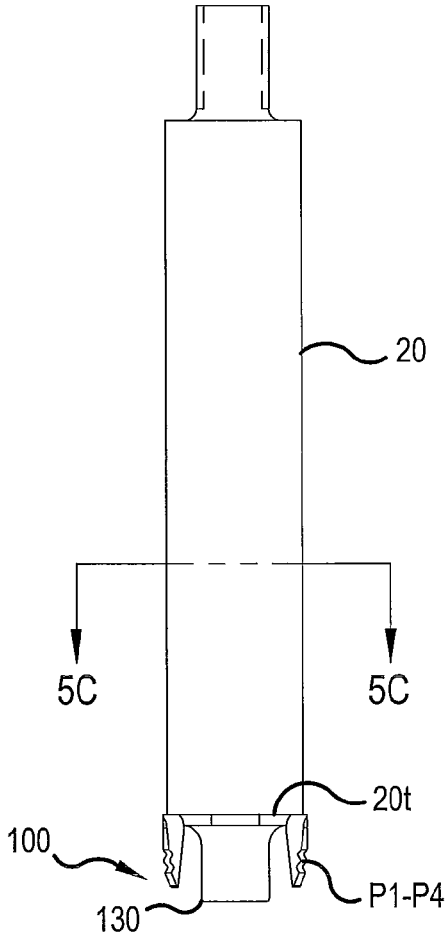
Figure 5C:
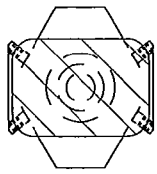
Figure 6A:
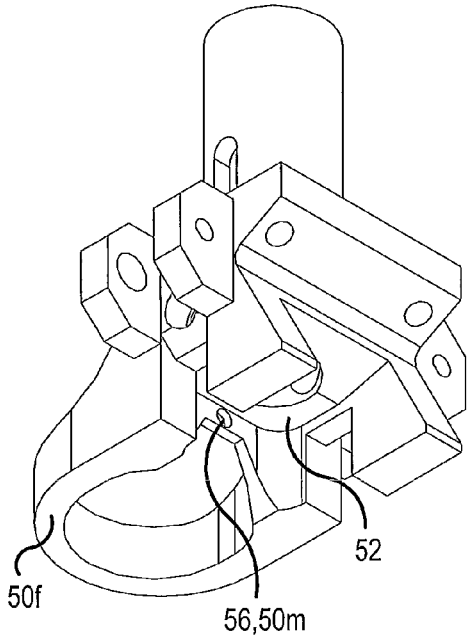
FIGS. 6(*a*) to 6(*h*) are additional views of a nose piece consistent with some embodiments of the present invention.
Figure 6B:
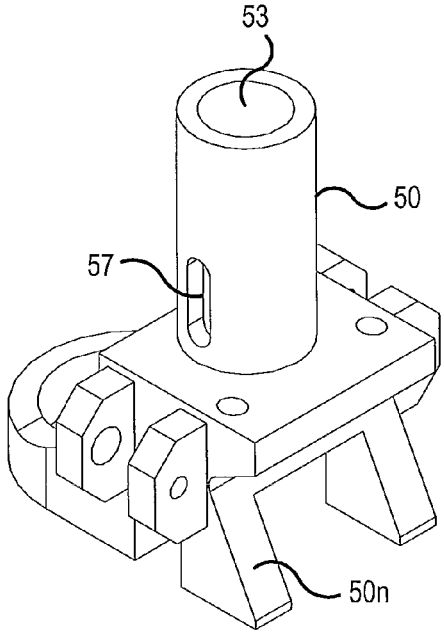
Figure 6C:
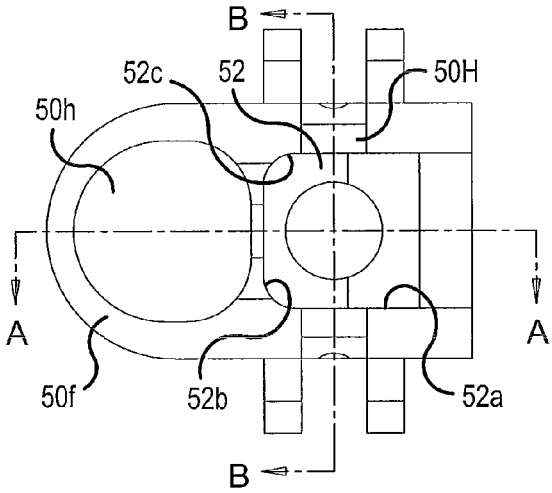
Figure 6D:
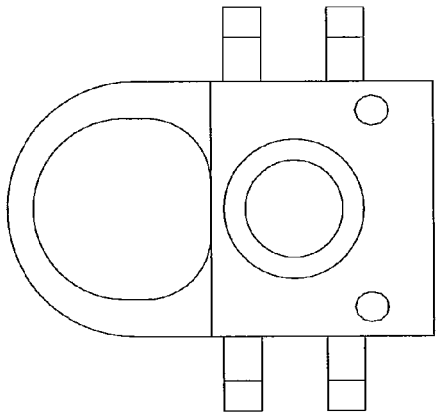
Figure 6E:
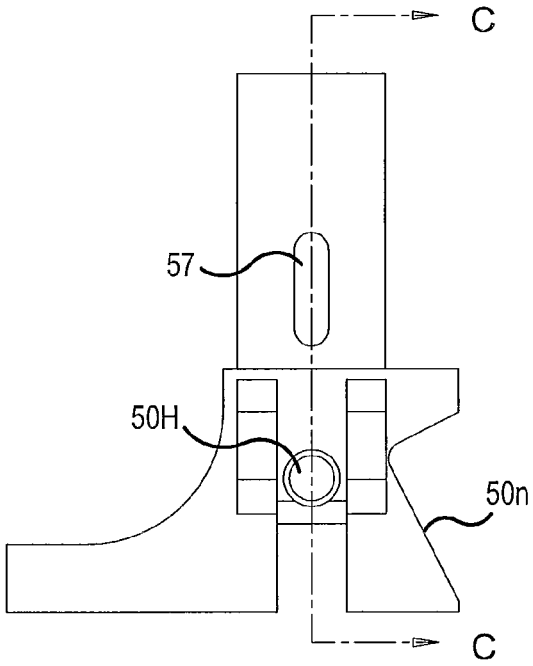
Figure 6F:
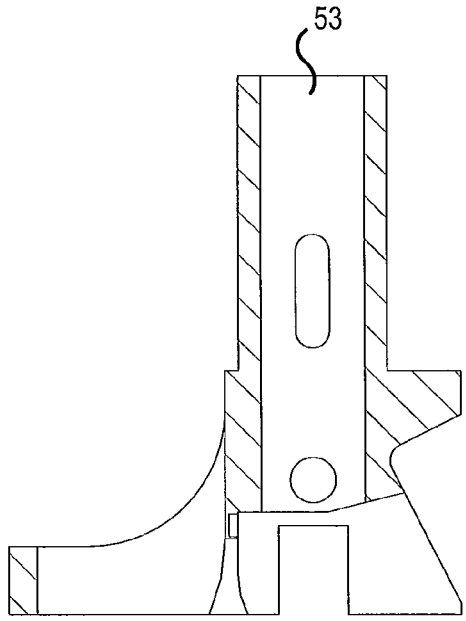
Figure 6G:
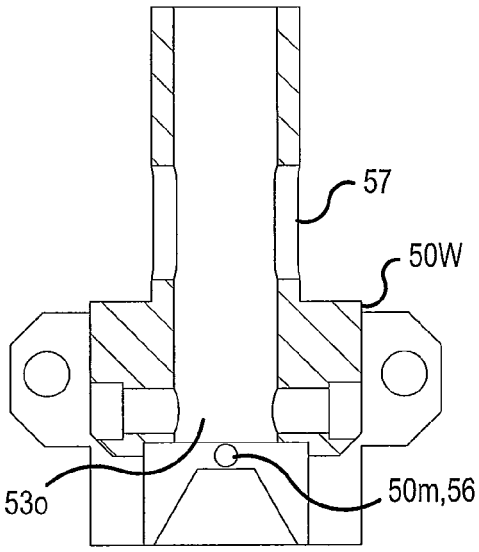
Figure 6H:
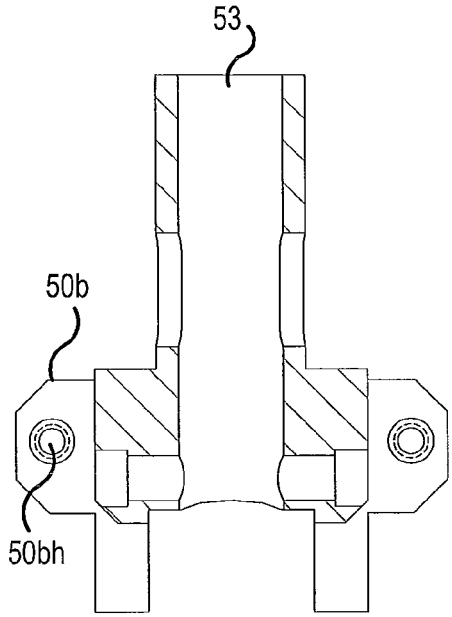
Figure 7A:
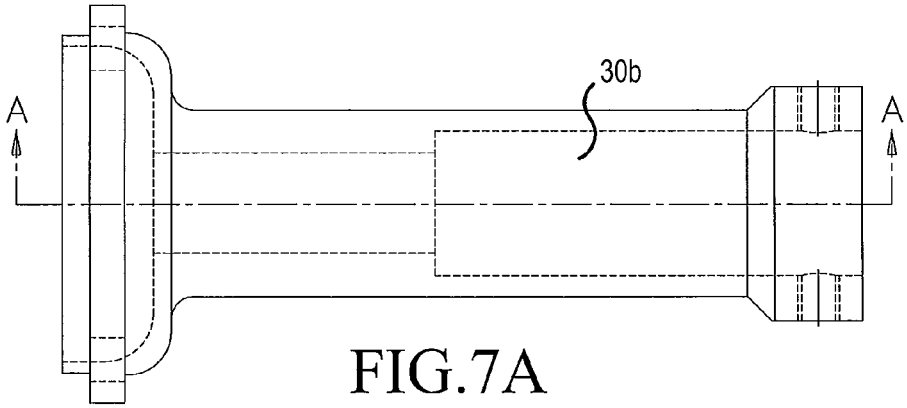
FIGS. 7(*a*) to 7(*d*) are views of a guide tube.
Figure 7B:
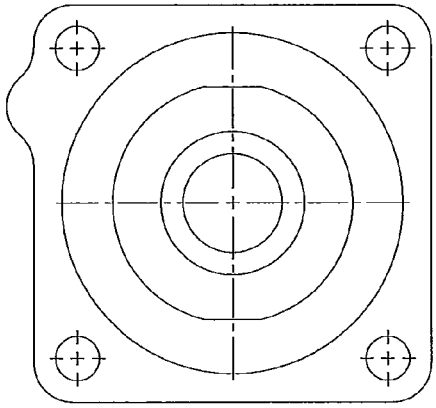
Figure 7C:
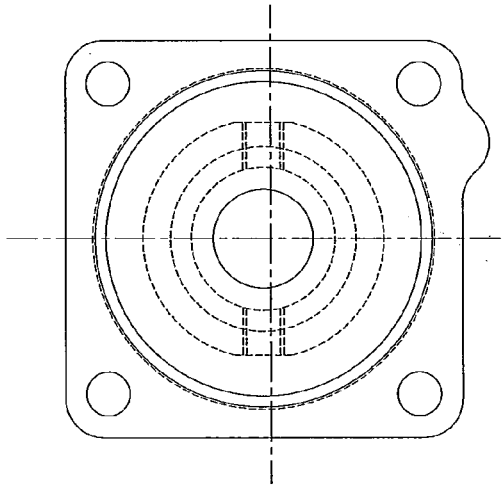
Figure 7D:
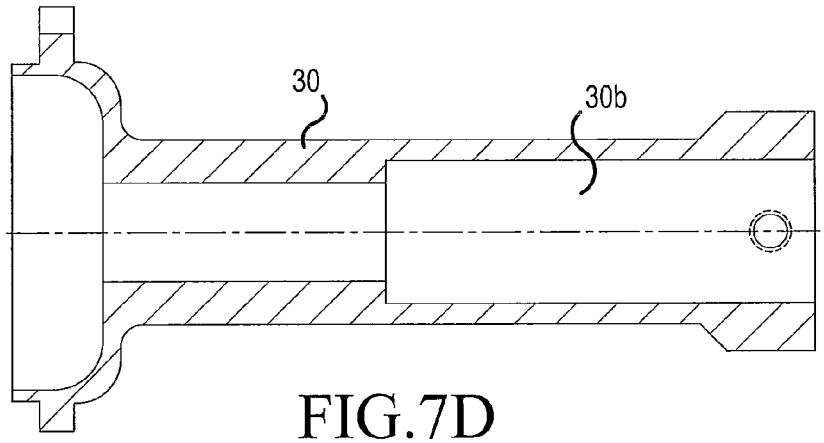

FIG. 5(*a*) illustrates a perspective view of an exemplary the drive rod 20 of the pneumatic hand tool 10. Tip end 20*t* of the drive rod 20 presses against the fixing elements 100 when driving the fixing elements. FIG. 5(*b*) is a side view of the drive rod 20 as viewed in the direction of arrows 5B in FIG. 5(*a*), and FIG. 5(*c*) is a sectional view of the drive rod as viewed in the direction of arrows 5C in FIG. 5(*b*). The drive rod 20 may have various cross sections, including rectangular, circular, for example.

With reference to FIGS. 6(*a*) to 6(*h*), one embodiment of the nose piece 50 is described in further detail. In particular, FIGS. 6(*a*) and 6(*b*) are perspective views, FIG. 6(*c*) is a bottom view, FIG. 6(*d*) is a plan view, and FIG. 6(*e*) is a side view. FIGS. 6(*b*) and 6(*e*), for example, illustrate vertical slot 57, through which stopper 30ST is inserted, and is secured to the guide tube 30. (Guide tube 30, stopper 30ST, and vertical slot 57 can be seen in FIG. 2(*b*).) Since the stopper 30ST extends into the vertical slot 57, up and down movement the nose piece 50 is limited by the length of the vertical slot 57. Horizontal slot 52 for accommodating the fixing element is illustrated in FIGS. 6(*a*) and 6(*c*).

FIG. 6(*f*) is a sectional view taken along line A-A of FIG. 6(*c*), FIG. 6(*g*) is a sectional view taken along line B-B of FIG. 6(*c*), and FIG. 6(*h*) is a sectional view taken along line C-C of FIG. 6(*e*). In FIG. 6(*c*), when the fixing element 100 is in position under the nose piece 50, it is constrained by the horizontal slot 52 from moving upwardly by a roof 52*f* of the slot 52, or from moving laterally by side walls 52*a*, 52*b*, 52*c* of the slot 52. FIG. 6(*b*) and FIGS. 6(*f*) to (*h*) also show drive channel (central bore) 53, and opening 53*o* at the bottom of drive channel (central bore) 53. FIGS. 6(*a*) and (*g*) illustrate a bore 56 for insertion of a magnet 50*m* into the nose piece 50. The magnet 50*m* assists in holding each of the fixing elements in the horizontal slot 52.

Now, referring to FIGS. 7(*a*) to 7(*d*), the guide tube 30 will be described. FIG. 7(*a*) provides a side view of the guide tube 30 and the central bore 30*b*. FIG. 7(*d*) is a sectional view as viewed in the direction of arrows A-A of FIG. 7(*a*). FIGS. 7(*b*) and 7(*c*) illustrate, respectively, the lower end and the upper end of the guide tube 30. The upper end of the guide tube 30, as shown in FIG. 7(*c*) is attached to the drive 12, as shown in FIG. 2. As can be seen by referring to FIG. 2 and FIGS. 7(*a*) and 7(*d*), nose piece is slidably fit into central bore 30*b*, and drive rod 20 is movable up and down in an axial direction within the drive channel 53.

Figure 8A:
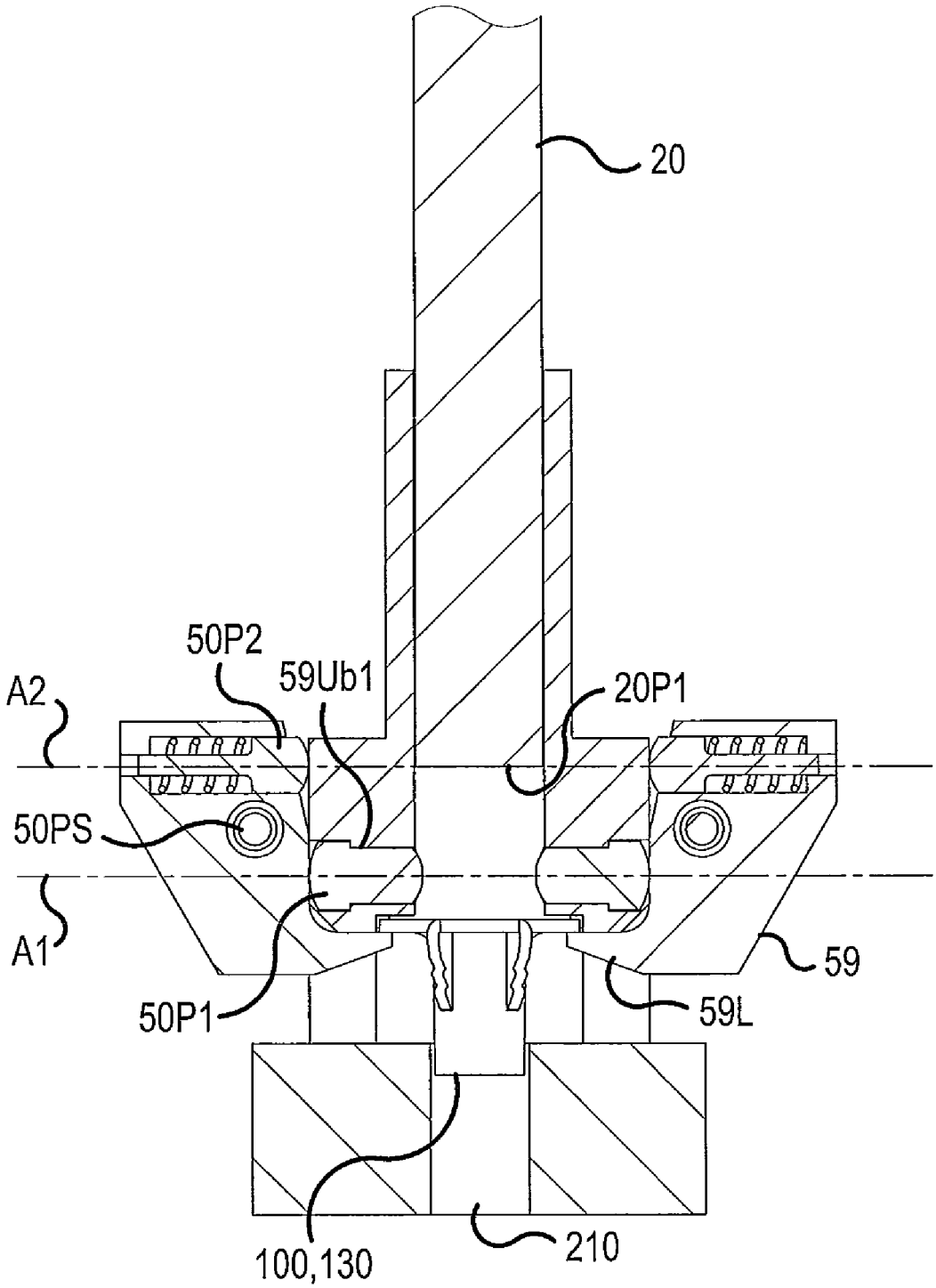
FIGS. 8(*a*) to 8(*c*) are cut-away views showing an exemplary sequence of locating a hole in a work piece, and inserting the fixing element into the hole of the work piece when the nose piece is resting on the work piece, consistent with some embodiments of the present invention.
Figure 8C:
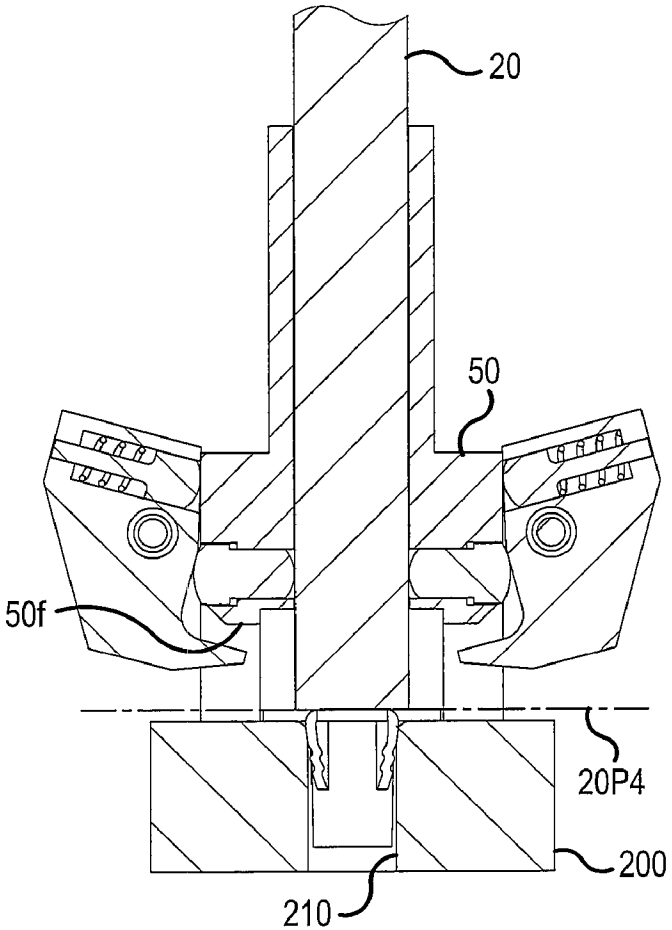
Figure 8B:
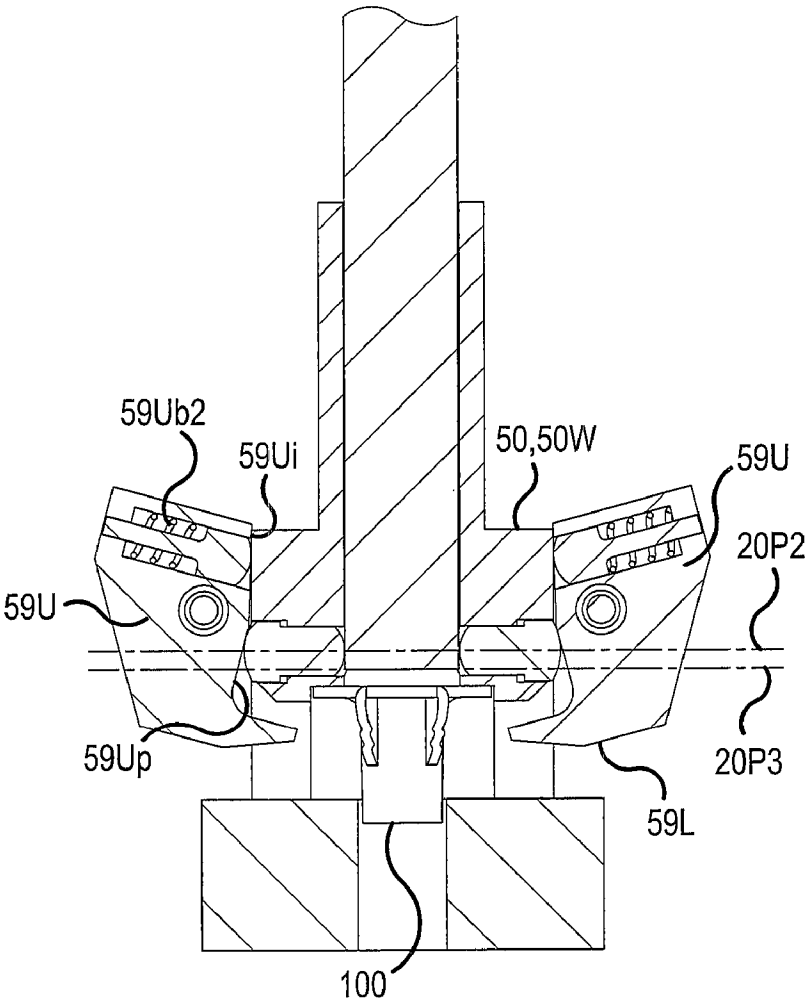
Figure 9A:
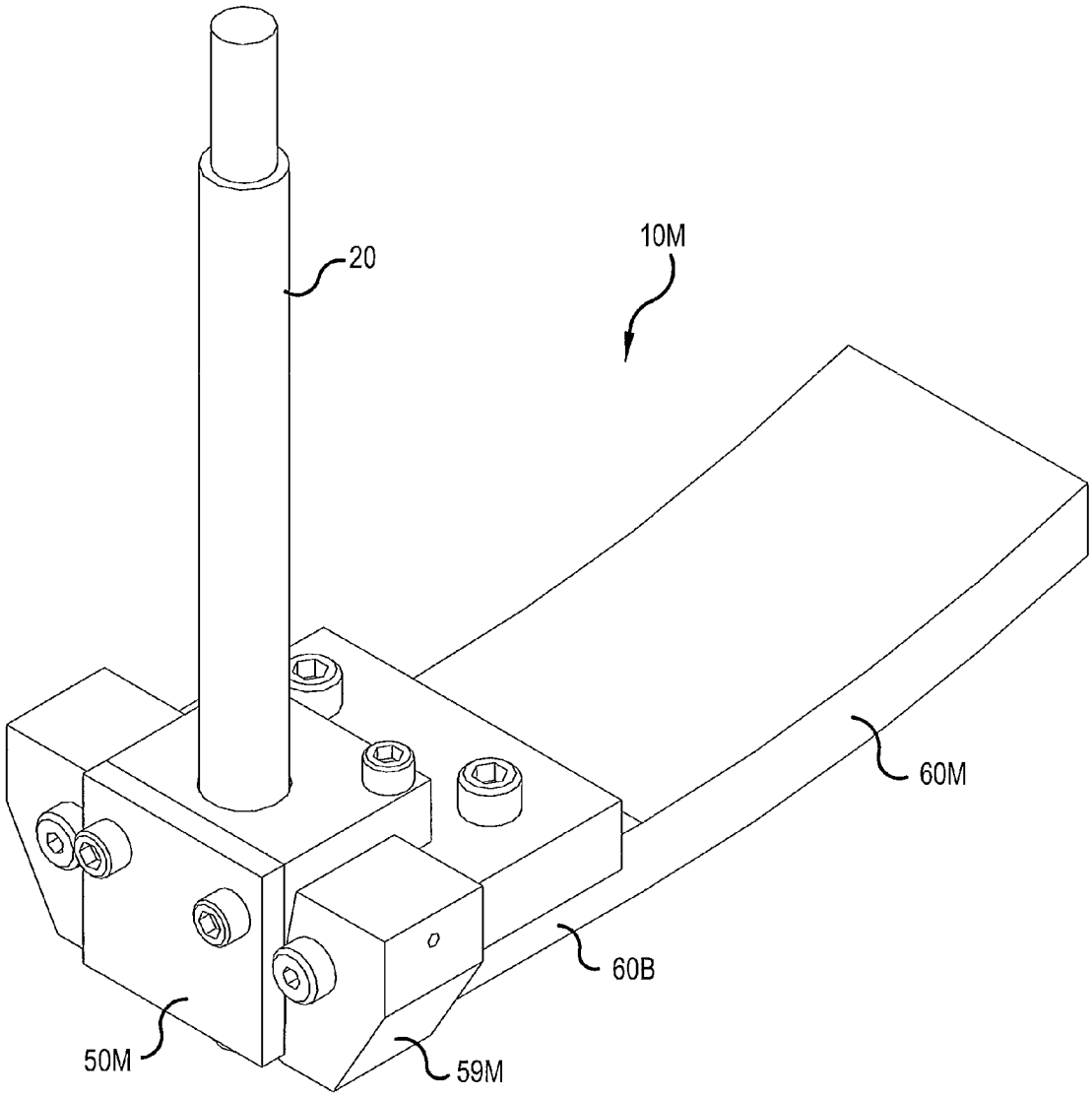
FIG. 9(*a*) to 9(*c*) are views of the nose piece/feed track assembly of a standalone machine consistent some embodiments of the present invention, in which FIG. 9(*a*) is a perspective view, FIG. 9(*b*) is a lengthwise sectional view, and FIG. 9(*c*) is an exploded view.
Figure 9B:
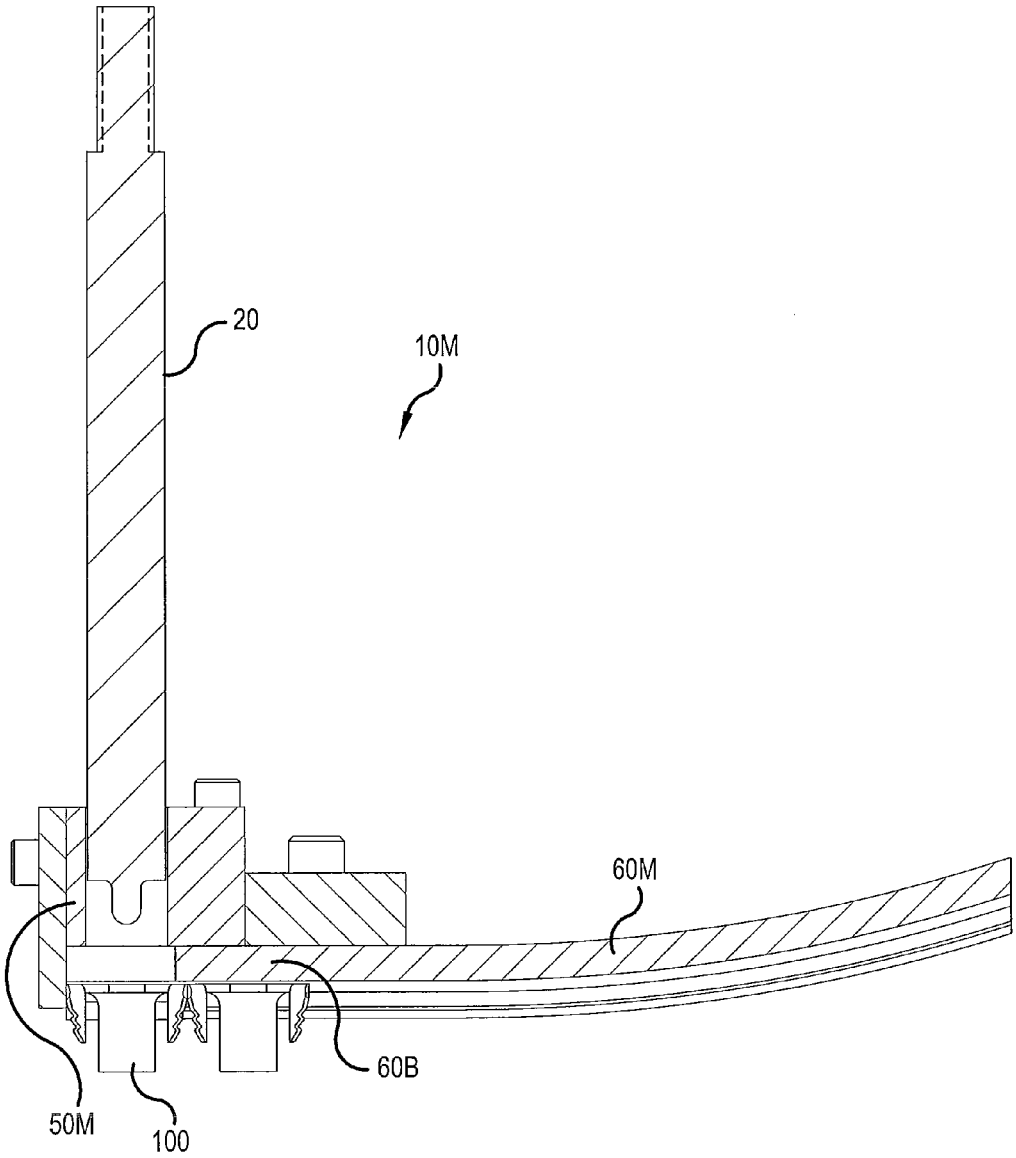
Figure 9C:
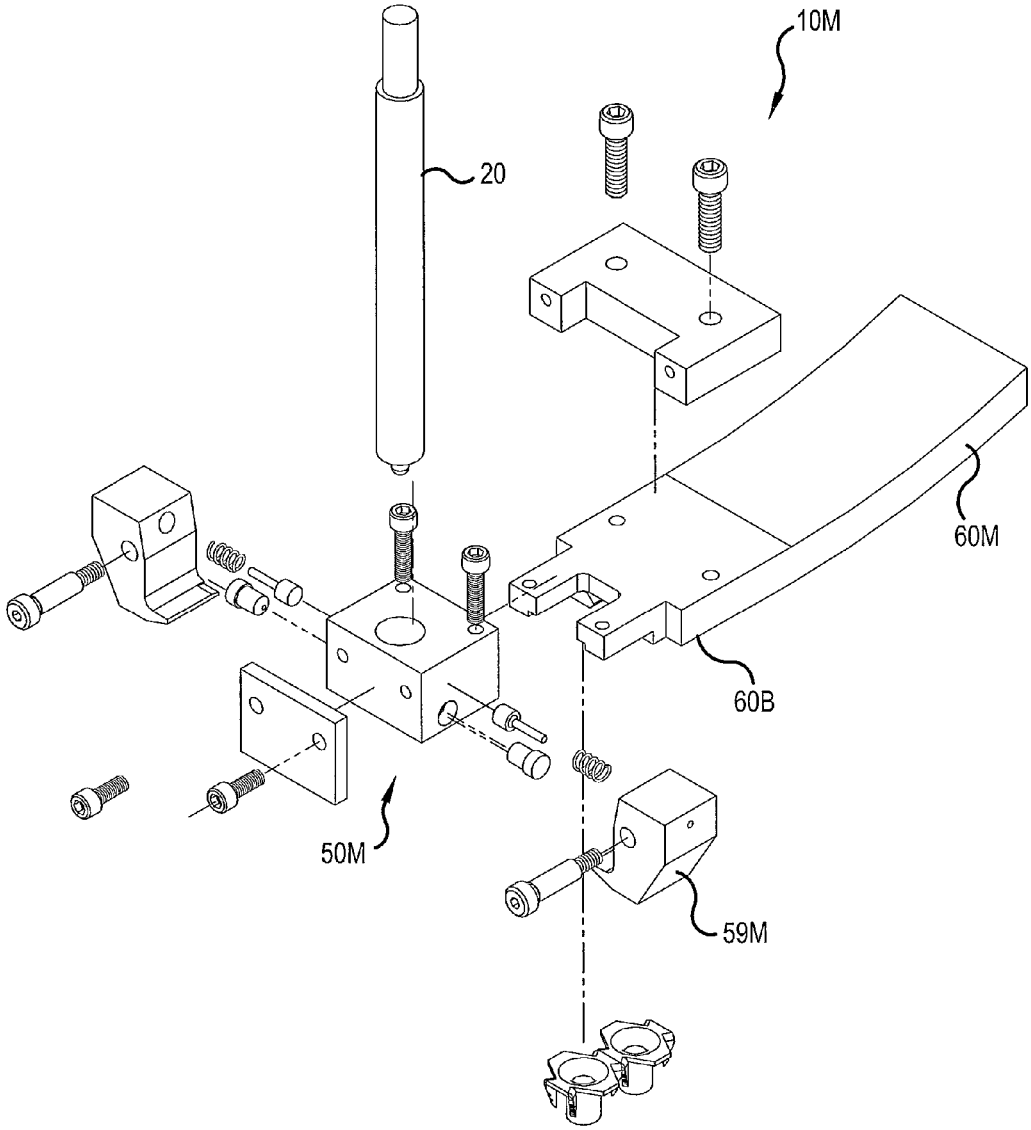
Figure 9F:
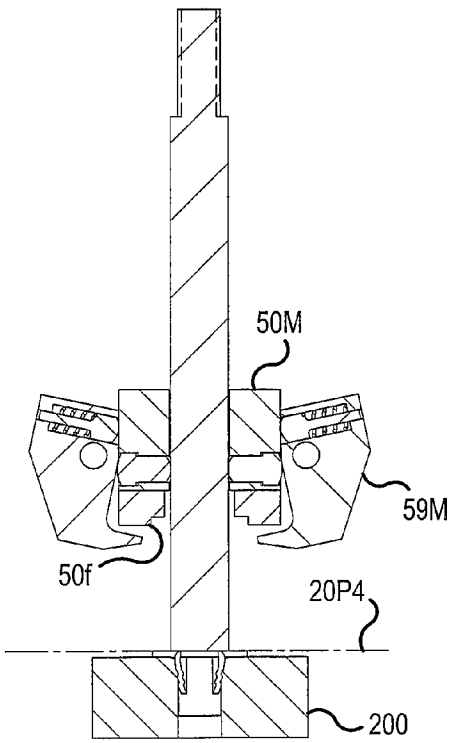
Figure 9E:
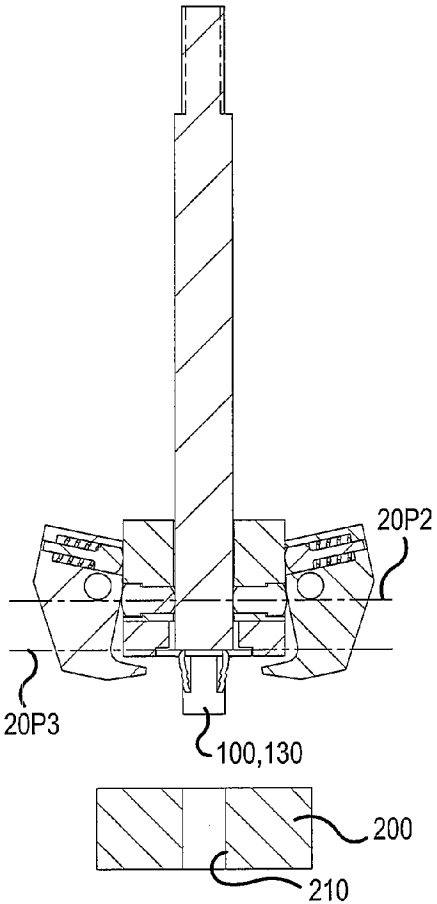
Figure 9D:
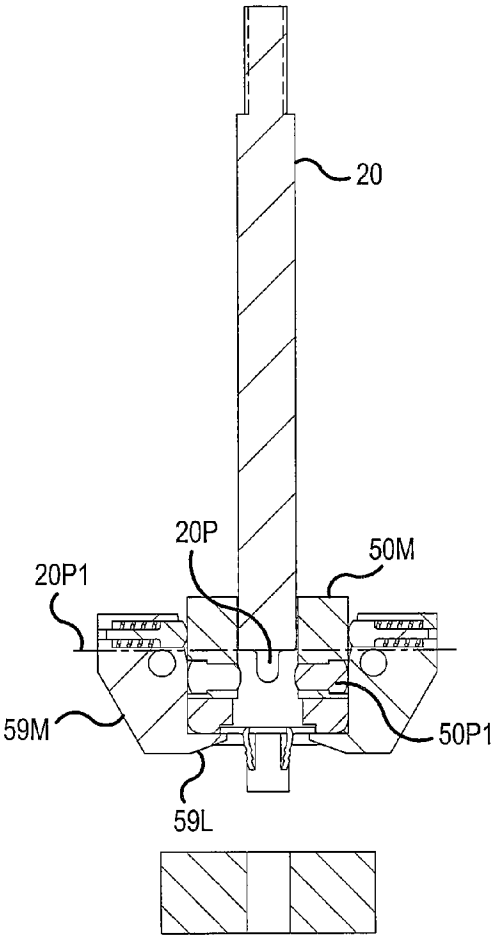

FIGS. 8(*a*) to 8(*c*) illustrate the functioning of a portable device with a pair of pivotable fingers 59 in cut-away drawings of the nose piece 50 during three successive stages of insertion.

Pivotable fingers 59 are mounted on opposite side walls of the nose piece 50 via pivot shafts 50PS. Each of the fingers 59 is substantially L-shaped, and includes a lower portion 59L and an upper portion 59U extending upwardly from the lower portion 59L. Inner faces 59Ui of the fingers 59 include pressing surfaces 59Up against which outer ends of the first actuators (for example, first plungers) 50P1 are capable of pressing. The first actuators 50P1 (for example, first plungers) are slidably positioned within bores 59Ub1 in the side walls 50W of the nose piece 50. When the drive rod 20 is acted on by a force from above and moves downwardly through the drive channel 53 of the nose piece 50, the drive rod 20 exerts a force on inner ends of the first actuators (for example, first plungers) 50P1, thereby pushing the first actuators (for example, first plungers) 50P1 against the inner faces 59Ui of the fingers, and thereby moving the fingers from a closed position, in which a lower portion 59L of the fingers are disposed under portions of the flange 110 of the first fixing element, to an open position, in which the lower portions 59L of the fingers 59 are disposed away from under portions of the flange 110 of the first fixing element. A bore 59Ub2 is formed in the inner face 59Ui of the upper portion 59U of each finger 59 for accommodating a second actuator (for example, second plunger) 50P2.

FIG. 8(*a*) illustrates the pivotable fingers 59 in a closed position, the drive rod 20 at an initial upper position 20P1, and the barrel 130 of the fixing element 130 (slightly inserted into the hole 210) prior to insertion of the prongs P1-P4 into the work piece 200. Lower portions 59L of the pivotable fingers 59 can be seen retaining the flange 110 of the fixing element 100 in the nose piece 50. As can be seen, when pivotable fingers 59 are in a closed position, axes A1 of the first actuators (for, example first plungers) 50P1 are parallel to axes A2 of the second actuators (for example, second plungers) 50P2, and inner ends of the first actuators (for example, first plungers 50P1 extend into the drive channel 53.

FIG. 8(*b*) illustrates drive rod 20 moving through a first intermediate position 20P2, in order to cause the first actuators (for example, first plungers) 50P1 to press against the pressing surface of the respective fingers 59 thereby moving the lower portions 59L of the fingers 59 away from under outer portions 110*o* of the flange, and the drive rod reaching the second intermediate position 20P3 at the upper surface of the fixing element 100.

In FIG. 8(*c*), the drive rod 20 has moved past the lower face of the nose piece 50 and has reached the lower position 20P4, and insertion of fixing element 100 into seat 210 of the work piece 200 is complete. After the fixing element 100 has been inserted into the work piece, the drive rod 20 returns to its initial upper position 20P1, and the pivotable fingers 59 return to the closed position, thereby pushing the first actuators (for example, first plungers) 50P1 inwardly so that the inner ends again extend into the drive channel 53. Once the fingers 59 have returned to the closed position, the nose piece 50 is ready to receive the next fixing element 100 from the feed track.

FIGS. 9(*a*) to 9(*c*) are views of the nose piece/feed track assembly of a standalone machine according to some embodiments of the present invention, in which FIG. 9(*a*) is a perspective view, FIG. 9(*b*) is a lengthwise cross-sectional view, and FIG. 9(*c*) is an exploded view. As can be seen, nose piece 50M is provided with pivotable fingers 59M. As shown in FIG. 9(*a*), lower face of the nose piece 50M is integrated with a downstream portion 60B of a feed track 60M which supplies the first fixing element. The downstream portion 60B of the feed track 60M extends at an angle that is parallel to the lower face of the nose piece 50M. Further, the downstream portion of the feed track 60M includes a horizontal slot adapted to receive a first fixing element 100 from the feed track 60M.

FIGS. 9(*d*) to 9(*f*) are cut-away drawings illustrating the functioning the pivotable fingers 59M of FIGS. 9(*a*) to 9(*c*), during three successive stages of insertion. While not shown in the drawings, the nose piece 50M of the standalone machine is generally positioned away from work piece. Note also, that drive rod 20 may include a guide pin 20*p* extending downwardly from a lower face of the drive rod 20. The guide pin 20*p* is inserted into the barrel 130 of the fixing elements, thereby stabilizing the fixing elements when they are being driven into the predefined seats 210.

As shown in the embodiment of FIGS. 9(*d*) to 9(*f*), the pivotable fingers 59M are mounted on opposite side walls of the nose piece 50M via pivot shafts 50PS. Each of the fingers 59M is substantially L-shaped, and includes a lower portion 59L and an upper portion 59U extend upward from the lower portion 59L. A bore 59Ub is formed in the inner face 59Ui of the upper portion 59U of each finger 59M for accommodating a second actuator (for example, second plunger) 50P2. The inner face 59Ui also includes a pressing surface 59Up against which outer ends of the first actuators (for example, first plungers) 50P1 are capable of pressing.

FIG. 9(*d*) illustrates the drive rod 20 at an initial upper position 20 P1, and the barrel 130 of the fixing element 130 prior to insertion of the prongs P1-P4 into the work piece 200. The pivotable fingers 59M can be seen retaining the flange 110 of the fixing element 100 in the nose piece 50M.

FIG. 9(*e*) illustrates drive rod 20 moving through the first intermediate position 20P2, in order to cause the first actuators (for example, first plungers) 50P1 to move the lower portions 59L of the fingers 59 away from under outer portions 110*o* of the flange 110, and reaching the second intermediate position 20P3 at the upper surface of the fixing element 100.

In FIG. 9(*f*) the drive rod has moved past the lower face 50*f* of the nose piece 50M and has reached the lower position 20P4, and insertion of fixing element 100 is complete. After the fixing element 100 has been inserted into the work piece, the drive rod 20 returns to its initial upper position 20P1.

Figure 10:
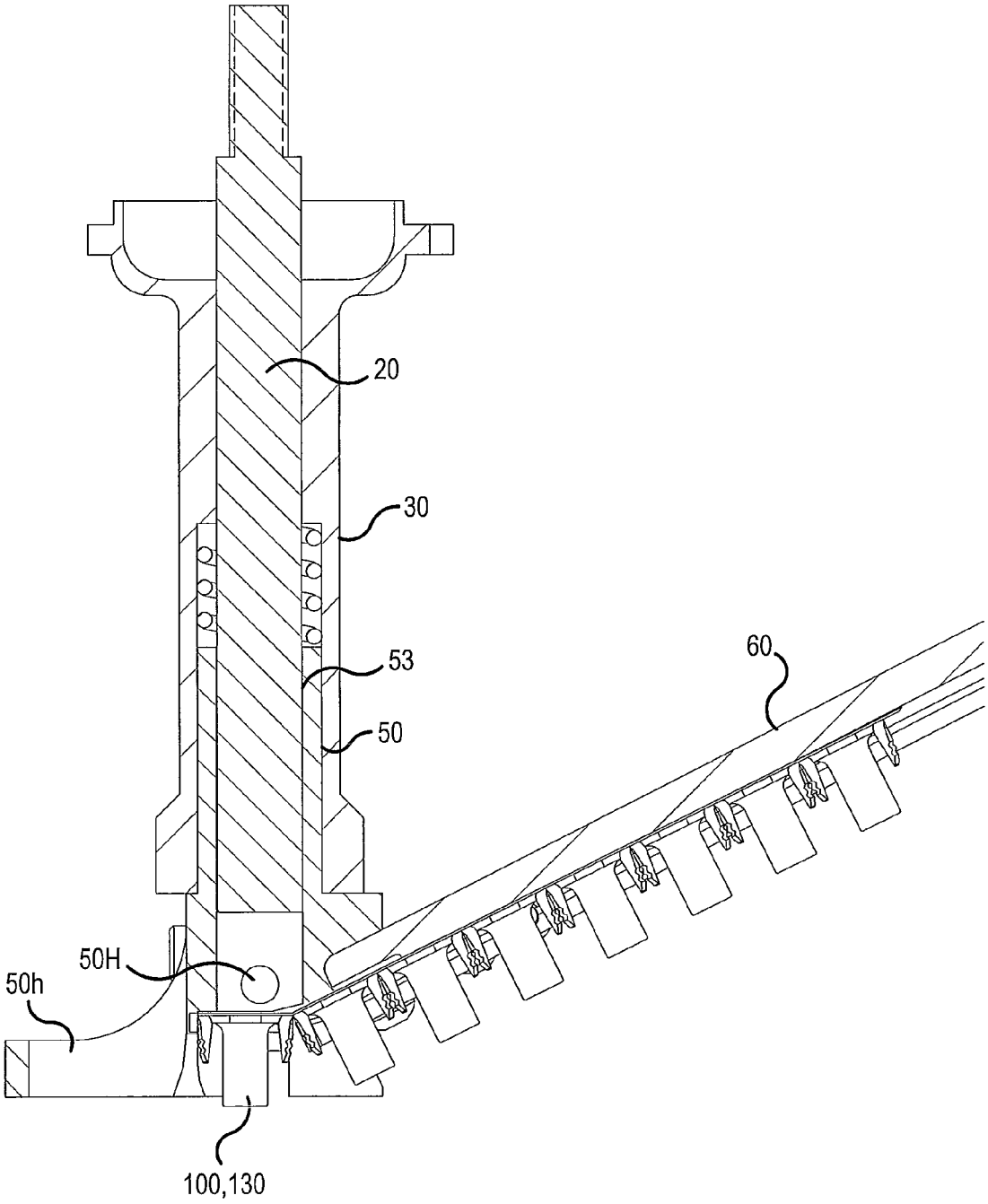
FIG. 10 is a side view of the nose piece, guide tube, and the magazine of the portable device consistent with an some embodiments of the present invention.
Figure 11B:
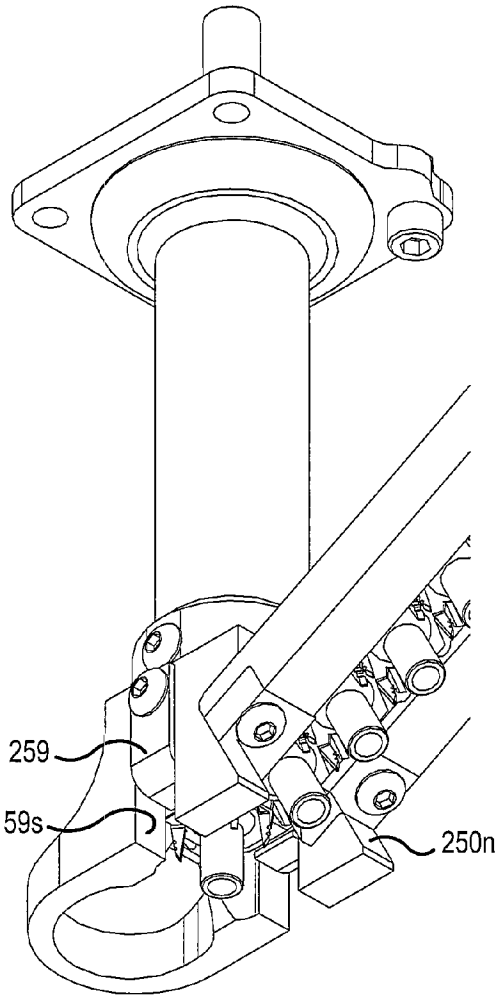
FIGS. 11(*a*) and 11(*b*) are perspective views of the nose piece as shown in FIG. 10 consistent with some embodiments of the present invention.
Figure 11A:
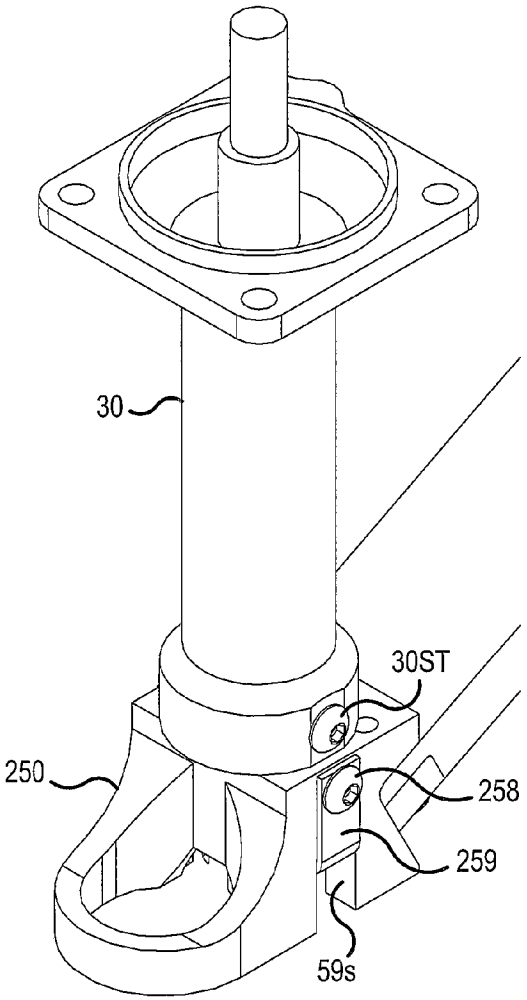
Figure 12C:
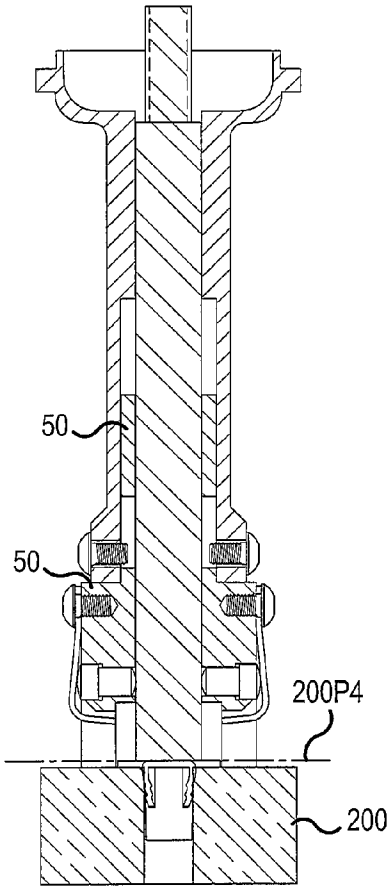
FIGS. 12(*a*) to 12(*c*) illustrate the functioning of fingers shown in FIG. 10 and FIGS. 11(*a*) and 11(*b*); consistent with the principles of some embodiments of the present invention.
Figure 12B:
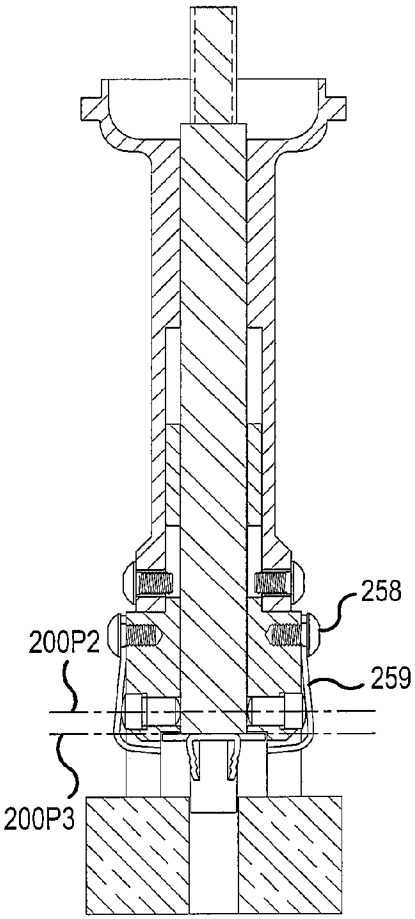
Figure 12A:
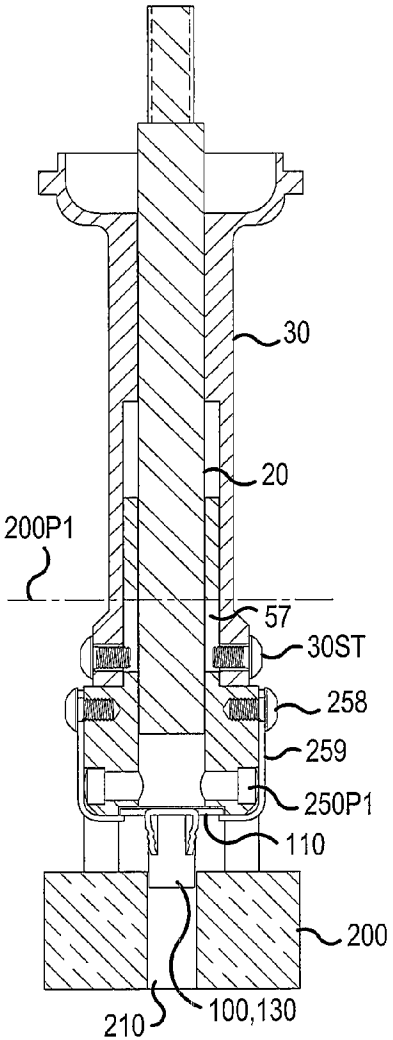

FIG. 10, FIGS. 11(*a*) and 11(*b*), and FIGS. 12(*a*) to 12(*c*) are exemplary illustrations of a nose piece 50 and a biasing member consistent with some embodiments of the present invention. FIG. 10 is a cut-away view of the embodiment illustrated in FIGS. 11(*a*) and (*b*), and shows the guide tube 30 and drive rod 20 received in the drive channel 53 of the nose piece 50. Whereas the embodiments described above used pivotable fingers 59, 59M to hold the fixing elements in place under the lower face 52 of the nose piece 50, in this embodiment, the biasing members are springs (for example, L-shaped flexible fingers) 259 attached to the nose piece 50 and which extend into slots 59*s*, thereby retaining the fixing elements 100 under the nose piece 50. In addition, one or more magnets 50*m* may be used in conjunction with the springs (flexible fingers) 259. The springs (for example, flexible fingers) 259 in this embodiment may be made of flexible spring strips, such as a flexible steel material, or other flexible material, and may be attached to the nose piece 50 by means of fasteners 258.

FIGS. 12(*a*) to 12(*c*) illustrate the functioning of the L-shaped flexible fingers 259 in cut-away drawings of the nose piece 50 during three successive stages of insertion. Also shown are, actuators (for example, plungers) 250P1, and initial upper position 200P1, first intermediate position 200P2, second intermediate position 200P3, and lower position 200P4 of the drive rod 20. In this embodiment, the flexible fingers 259 perform the biasing function that is performed by the second actuators (for example, second plungers) as shown, for example, in FIGS. 8(*a*)-8(*c*) and FIGS. 9(*d*) to 9(*f*).

FIG. 12(*a*) illustrates the drive rod 20 at an initial upper position 20P1, and the barrel 130 of the fixing element 130 (slightly inserted into the seat 210) prior to insertion of the one or more prongs P1-P4 into the work piece 200. The flexible fingers 59 can be seen retaining the flange 110 of the fixing element 100 in the nose piece 50.

FIG. 12(*b*) illustrates drive rod 20 moving through the first intermediate position 200P2, in order to cause the actuators (for example, plungers) 250P1 to move the lower portions of the fingers 259 away from under the flange 110, and reaching the second intermediate position 200P3 at the upper surface of the fixing element 100.

In FIG. 12(*c*) the drive rod 20 has moved past the lower face of the nose piece 50 and has reached the lower position 200P4, and insertion of fixing element 100 is complete. The fixing element 100 is fully inserted into the work piece 200. After the fixing element 100 has been inserted into the work piece, the drive rod returns to its initial upper position 200P1.

Figure 13:
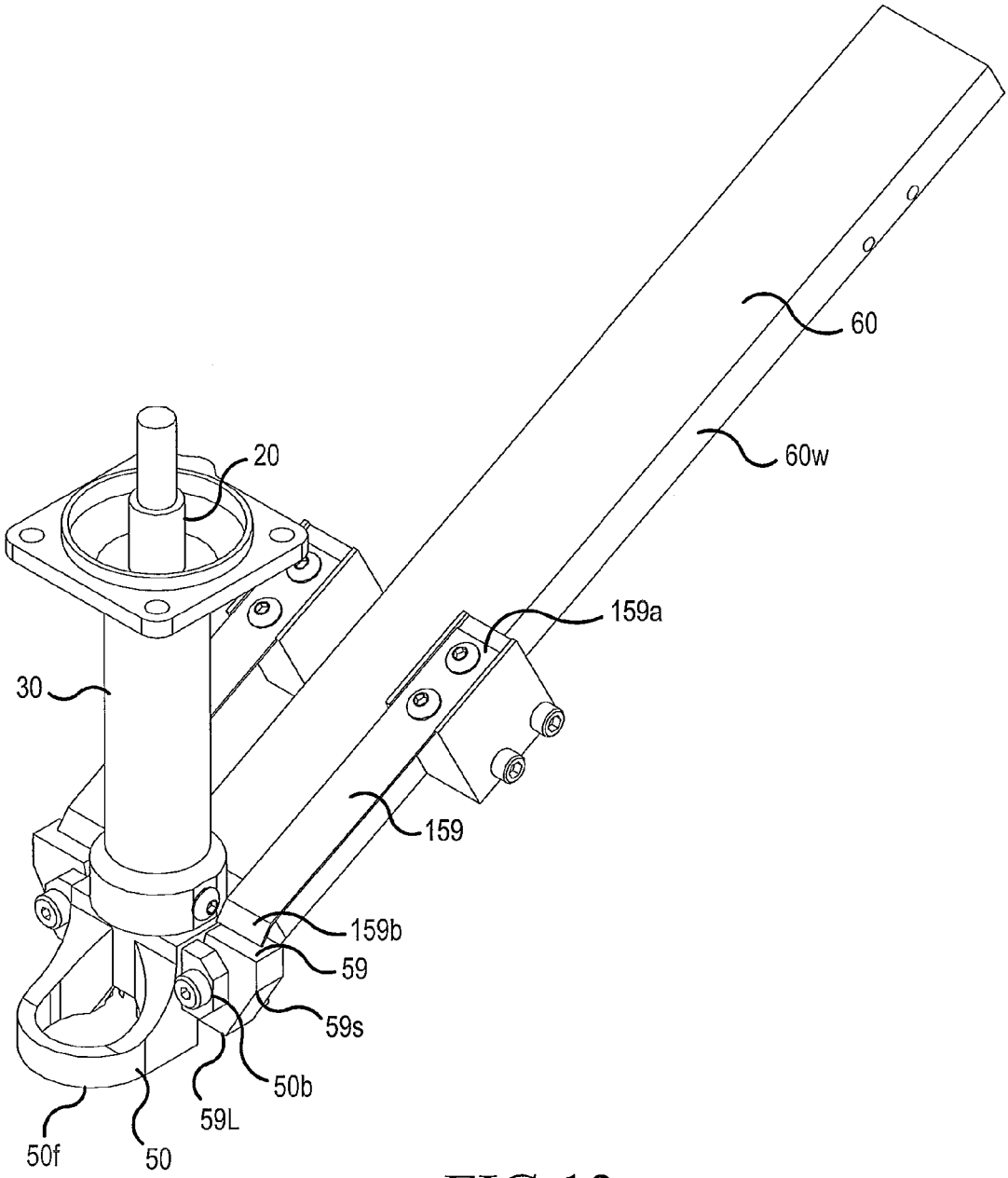
FIG. 13 illustrates pivotable fingers are held in a closed position by a pair of springs (flexible fingers) mounted on the feed track consistent with some embodiments of the present invention.

FIG. 13 illustrates another alternative embodiment in which the pivotable fingers 59 are held in a closed position by a biasing member 159 mounted on the feed track 60. The feed track 60 mounted on the nose piece 50 and extends upwardly at angle of 45° or less with respect the lower face 50*f* of the nose piece 50.

In this embodiment, the biasing member 159 is formed as a pair of flexible fingers 159, each of which includes a spring or strip of flexible material. A first end 159*a* of each of the flexible fingers 159 is fixed, respectively, to an opposite side wall 60W of the feed track 60, or fixed to other parts of the device 10, and a second end 159*b* of each of the flexible fingers 159 applies the biasing force to an upper surface 59*s* of the corresponding pivotably mounted finger 59, wherein the lower portion 59L of each of the fingers 59 is positioned under outer portions 110*o* of the flange 110 of the fixing element 100.

When drive rod 20 is in the initial upper position 20P1, the biasing force applied to upper surfaces 59*s* each of the pivotable fingers 59 causes the lower portions 59L of the pivotably mounted fingers 59 to extend under the opposite outer portions of the flange 110 of the first fixing element 100 held under the lower face 50*f* of the nose piece 50. As previously described, when the drive 20 rod moves through the first intermediate position 20P2, a force of the drive rod 20 causes the first actuator (for example, first plunger 50P1, as shown in FIGS. 8(*a*) to 8(*c*) to move each of the pivotable fingers 59, which causes the pivotable fingers 59 to rotate against the biasing force, and causes the lower portions 59L of the pivotable fingers 59 to move away from under the outer portions of flange 110 of the first fixing element 100. In this embodiment, the flexible fingers 159 perform the biasing function that is performed by the second actuators (for example second plungers) as shown, for example, in FIGS. 8(*a*)-8(*c*) and FIGS. 9(*d*) to 9(*f*).

Figure 14:
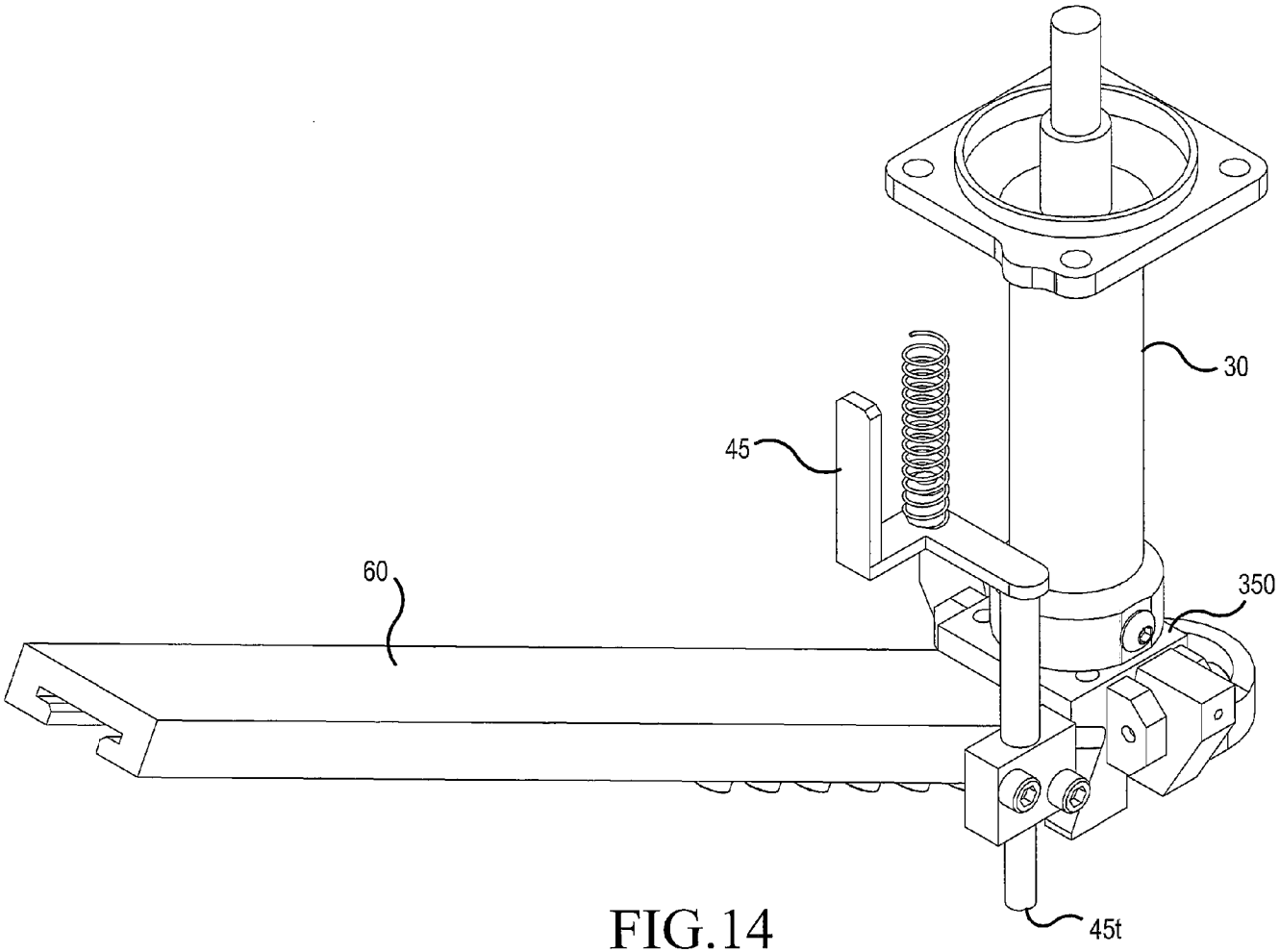
FIG. 14 illustrates a portable device with a fixed nose piece with a separate movable safety mechanism, the lower tip of which projects below the nosepiece consistent with some embodiments of the present invention.

FIG. 14 illustrates a portable device with a nose piece 350 and a separate movable safety mechanism 45 (see also FIG. 2), the lower tip 45*t* of which projects below the nosepiece 350. The safety mechanism 45 prevents the downward drive force from being applied to the drive rod 20, until the nose piece 350 and the safety mechanism 45 are rested on the work piece 200, and the nose piece 350 and safety mechanism 45 are caused to move upwardly when the operator applies a downward force on the portable device 10.

Figure 15A:
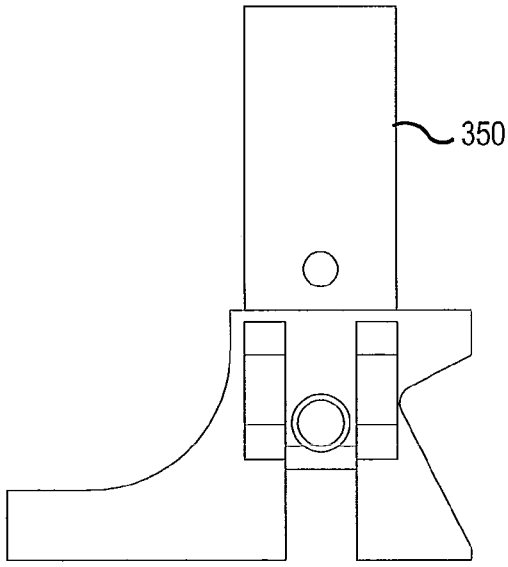
FIG. 15(*a*) is a detailed side view of the fixed nose piece shown in FIG. 14, and FIG. 15(*b*) is a perspective view of the fixed nose piece shown in FIG. 14, consistent with some embodiments of the present invention.
Figure 15B:
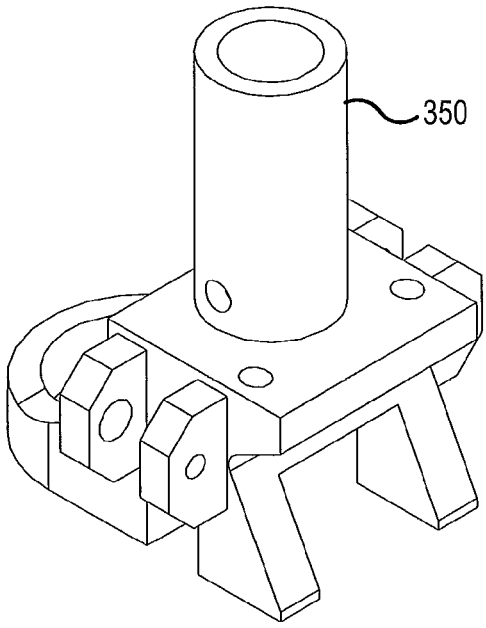
Figure 16:
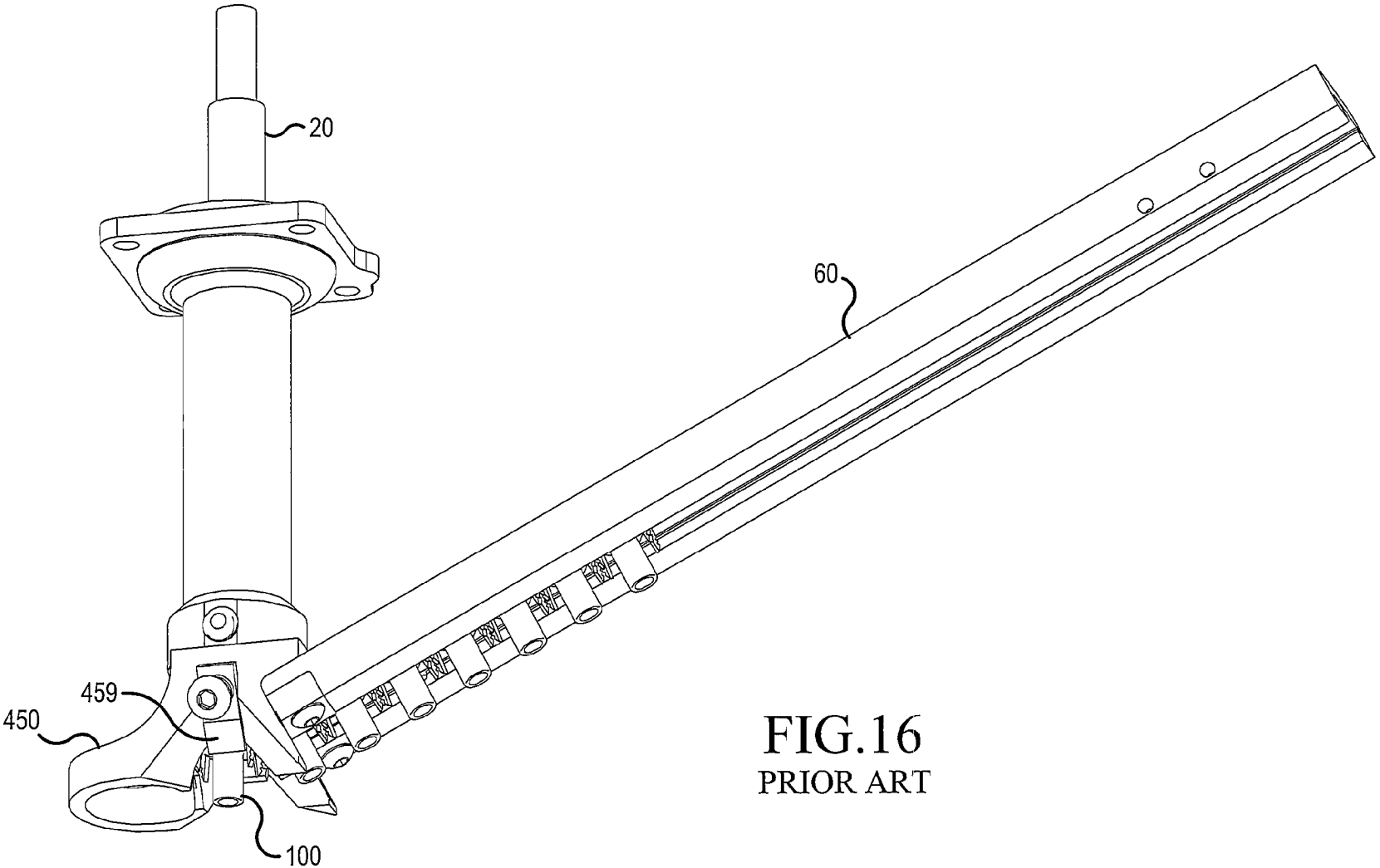
FIG.16 PRIOR ART
FIG. 16 is a perspective view of conventional portable device having a nose piece with angled fingers that do not open prior to driving the fixing element into the work piece.
Figure 17:
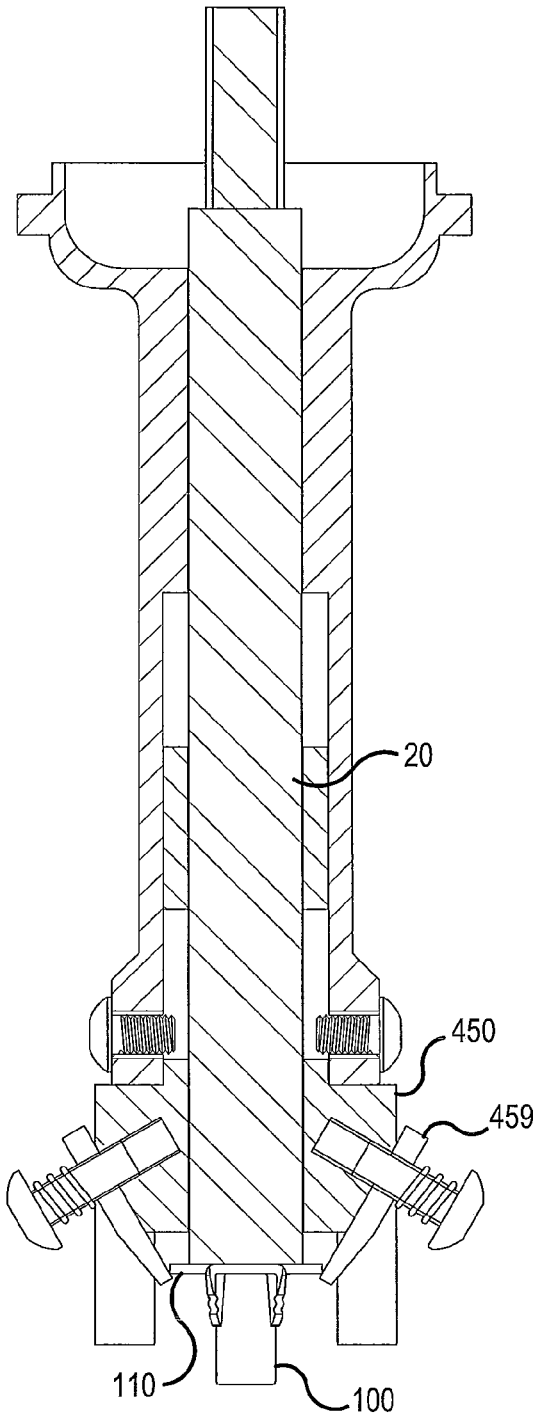
FIG.17 PRIOR ART
FIG. 17 is a cut-away view of conventional portable device of FIG. 16, having a nose piece with angled fingers that do not open prior to driving the fixing element into the work piece.
Figure 18:
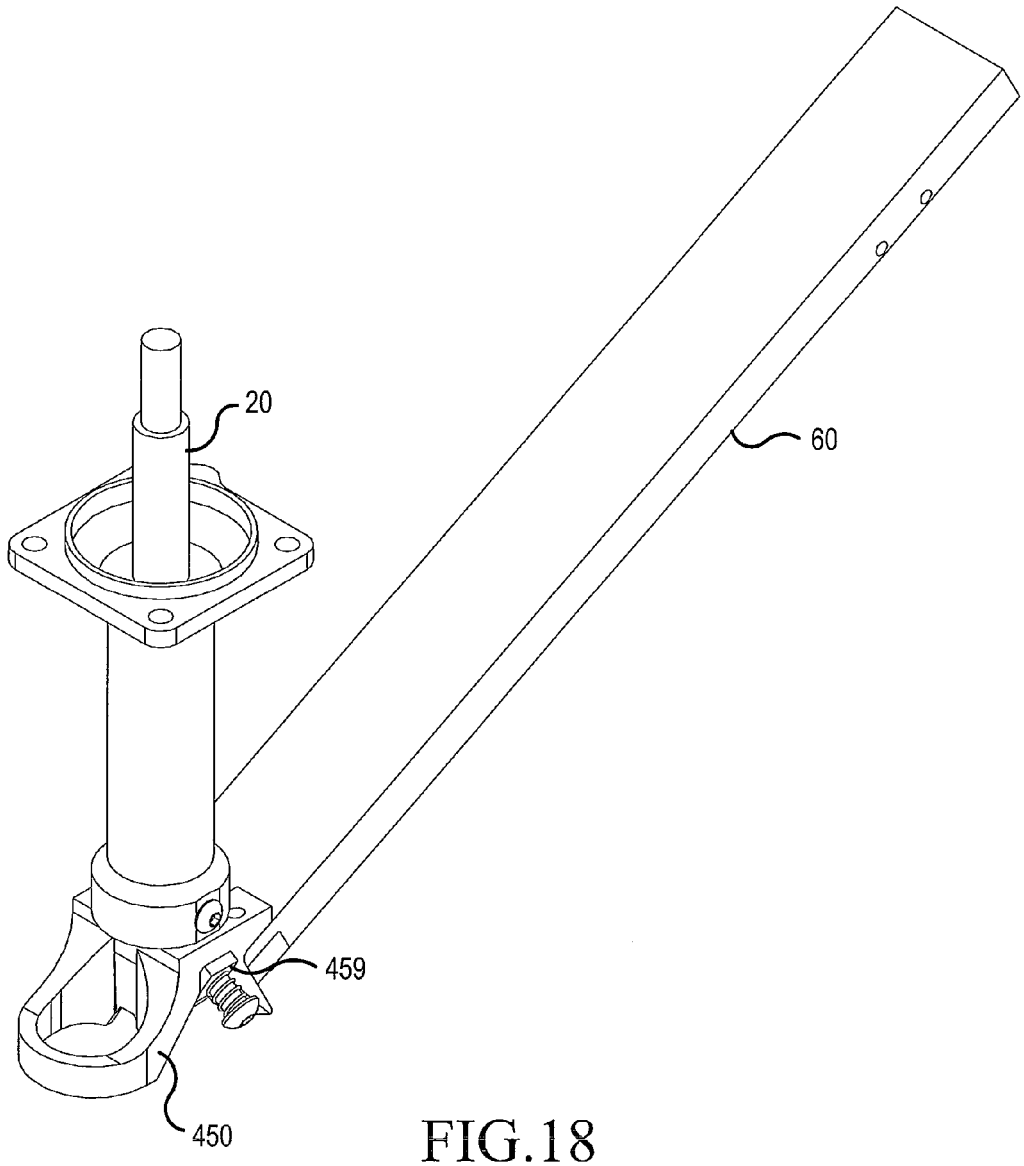
FIG.18 PRIOR ART
FIG. 18 is another perspective view of conventional portable device of FIG. 16, having a nose piece with angled fingers that do not open prior to driving the fixing element into the work piece.

FIG. 15(*a*) is a detailed side view of the fixed nose piece shown in FIG. 14, and FIG. 15(*b*) is a perspective view of the fixed nose piece shown in FIG. 14.

With each of the innovative nose piece and finger arrangements described above, the lower portions of the fingers are moved away from the outer portions of the flanges of the fixing elements prior to when the downward moving drive rod reaches fixing elements. Since, the outer portions of the flanges of the fixing elements no longer are used to force open the fingers, the problem of a bent and a distorted flange is eliminated. Since, the outer portions of the flanges of the fixing elements no longer are used to force open the fingers, the problems of the fixing elements being inserted into seats at an improper angle is minimized. Since, the outer portions of the flanges of the fixing elements no longer are used to force open the fingers, the speed of the drive rod of portable hand tools or standalone machines of all types can be increased, thereby allowing the use of lighter and more compact drive heads and increasing productivity and operational efficiency.

Many other variations of the nose piece and finger arrangement described above are possible, and are included within the scope of the invention. For example, the nose piece of a portable device and a standalone machine may be vertically movable or fixed with respect to the drive head. Any of the variations of pivotable fingers, flexible fingers, springs, and track-mounted fingers described herein may be used separately, or in combination with each other, in conjunction with a either a portable device in which the drive rod that is driven by hand, a portable hand tool in which the drive rod is driven by a pnuematic force or any other downward force, or a standalone automated machine.

In addition, the fingers may be mounted directly on the nose piece, or alternatively may be mounted directly on the downstream end of the feed track that is integrated with the nose piece. Further, the actuators are not limited to movable members or slidable plungers which are arranged perpendicular to the drive channel. For example, an alternative actuator may be mounted at an different angle with respect to the drive channel, or be mounted outside of the fingers.

Another alternatve implementation is to form the actuator integrally with an inner face of a pivotable or flexible L-shaped finger. Such an actuator formed integrally with the finger would extend through the opening formed on the side wall of the nose piece, and have an inner end extending into the drive channel.

Still further, the biasing member providing the biasing force to hold the fingers in a closed position may have various forms, including one or more strip springs, one or more coil springs, and the biasing member may be located inside or outside of the nose piece.

Also, the nose piece of the invention may accommodate various types of fixing elements, including any fastener having a flange. These may include nails and threaded fasteners for insertion into a work piece with or without predefined seats, and fasteners with hollow or closed barrels, with or without prongs, and with or without barrels having threaded portions.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method for inserting a fixing element into each of at least one predefined seat of a work piece, comprising:

providing a first fixing element at a lower face of a nose piece in a position facing a first end of a drive rod, the first end of the drive rod being received in a drive channel of the nose piece;

the drive rod receiving a downward drive force on a second end thereof;

the drive force moving the drive rod from an initial upper position, through a first intermediate position, and toward a lower position;

the drive rod exerting a force on an actuator while moving through the first intermediate position;

the actuator exerting a force on at least one finger, which is biased toward a side wall of the nose piece; and thereby moving the finger from a closed position in which a lower portion of the finger is disposed under an outer portion of the flange of the first fixing element, to an open position in which the lower portion of the finger is moved away from under the outer portion of the flange of the first fixing element; and upon reaching the lower position, the downward drive force on the drive rod inserting the first fixing element into a first predefined seat of the work piece, wherein the actuator is a movable member accommodated in an opening penetrating through the side wall of the nose piece, the movable member having an inner end extending into the drive channel when the finger is in the closed position, and wherein when the drive rod moves through the first intermediate position, the drive rod causes the movable member to move the finger, which causes the lower portion of the finger to move away from under the outer portion of the flange of the first fixing element.

2. The method for inserting a fixing element into a predefined seat of a work piece of claim 1, further comprising:

moving the drive rod through a second intermediate position which is a positioned between the first intermediate position and the lower position, and ejecting the first fixing element from the lower face of the nose piece.

3. The method for inserting a fixing element into a predefined seat of a work piece of claim 2, further comprising:

returning the drive rod toward the initial upper position, thereby enabling the finger, which is biased toward the side wall of the nose piece, to return to the closed position, providing a second fixing element at the lower face of the nose piece, and moving either the work piece or the nose piece so that the second fixing element is located directly above a second predefined seat of the work piece.

4. The method for inserting a fixing element into a predefined seat of a work piece of claim 3, wherein when the work piece includes multiple predefined seats, the method further comprising:

repeating the method of claim 3 until each of the multiple predefined seats of the work piece has received a different fixing element.

5. A nose piece for inserting fixing elements into predefined seats in a work piece, the nose piece comprising:

a drive channel extending along a vertical axis of the nose piece, the drive channel being adapted to receive a lower end of a drive rod, the drive rod being movable from an initial upper position, through a first intermediate position, and to a lower position when acted on from above on by a drive force;

a lower face of the nose piece adapted to receive a first fixing element; and a side wall of the nose piece toward which at least one finger is biased, wherein when the drive rod moves through the first intermediate position, a force from the drive rod is exerted on an actuator, and the actuator moves the finger from a closed position, in which a lower portion of the finger is disposed under an outer portion of the flange of the first fixing element, to an open position, in which the lower portion of the finger is disposed away from under the outer portion of the flange of the first fixing element, wherein the actuator is a movable member accommodated in an opening penetrating through the side wall of the nose piece, the movable member having an inner end extending into the drive channel when the finger is in the closed position, and wherein when the drive rod moves through the first intermediate position, the drive rod causes the movable member to move the finger, which causes the lower portion of the finger to move away from under the outer portion of the flange of the first fixing element.

6. The nose piece for inserting fixing elements according to claim 5, wherein the drive rod is movable through a second intermediate position disposed between the first intermediate position and the lower position, and wherein when the drive rod moves through the second intermediate position, the drive rod is adapted to eject the first fixing element from the lower face.

7. The nose piece for inserting fixing elements according to claim 6, wherein when the drive rod reaches the lower position, the drive rod is adapted to drive the first fixing element into a first predefined seat in the work piece.

8. The nose piece for inserting fixing elements according to claim 7, wherein after the drive rod reaches the lower position, the drive rod is adapted to return to the initial upper position, and the finger, which is biased toward the side wall of the nose piece, returns to the closed position.

9. The nose piece for inserting fixing elements according to 5, wherein the finger is a pair of pivotable fingers which are pivotably mounted via pivot shafts on opposite side walls of the nose piece.

10. The nose piece for inserting fixing elements according to 9, wherein each of the fingers is substantially L-shaped, the lower portion of the each of the L-shaped fingers extending under the outer portion of the flange of the first fixing element, and wherein each of the fingers includes a biasing member that biases the fingers toward the side wall of the nose piece.

11. An apparatus for inserting fixing elements into predefined seats in a work piece, the apparatus comprising:

a drive rod that is movable in an axial direction from an initial upper position, through a first intermediate position, and to a lower position when acted upon by a drive force exerted from above;

a nose piece having a central drive channel adapted to receive a lower end of the drive rod, and a lower face that is adapted to receive a first fixing element; and at least one finger biased toward a side wall of the nose piece, wherein when the drive rod moves through the first intermediate position, a force from the drive rod is exerted on an actuator, and the actuator moves the finger from a closed position, in which a lower portion of the finger is disposed under an outer portion of a flange of the first fixing element, to an open position, in which the lower portion of the finger is disposed away from under the outer portion of the flange of the first fixing element, wherein the actuator is a movable member accommodated in an opening penetrating through the side wall of the nose piece, the movable member having an inner end extending into the drive channel when the finger is in the closed position, and wherein when the drive rod moves through the first intermediate position, the drive rod causes the movable member to move the finger, which causes the lower portion of the finger to move away from under the outer portion of the flange of the first fixing element.

12. The apparatus for inserting fixing elements according to claim 11, wherein the drive rod is movable through a second intermediate position disposed between the first intermediate position and the lower position, and wherein when the drive rod moves through the second intermediate position, the drive rod is adapted to eject the first fixing element from the lower face.

13. The apparatus for inserting fixing elements according to claim 12, wherein when the drive rod reaches the lower position, the drive rod is adapted to drive the first fixing element into a first predefined seat in the work piece.

14. The apparatus for inserting fixing elements according to claim 13, wherein after the drive rod reaches the lower position, the drive rod is adapted to return to the initial upper position, and the finger, which is biased toward the side wall of the nose piece, returns to the closed position.

15. The apparatus for inserting fixing elements according to claim 11, wherein the finger includes a pair of pivotable fingers which are pivotably mounted via pivot shafts on opposite side walls of the nose piece.

16. The apparatus for inserting fixing elements according to claim 15, wherein each of the fingers is substantially L-shaped, the lower portion of the each of the L-shaped fingers extending under the outer portion of the flange of the first fixing element.

wherein a biasing member is provided to bias the fingers toward the side wall of the nose piece.

17. The apparatus for inserting fixing elements according to claim 16, wherein when the drive rod is in the initial upper position, the biasing force applied to each of the pivotable fingers causes the lower portions of the pivotable fingers to extend under the outer portion of the flange of the first fixing element in a horizontal slot on the lower face of the nose piece, and wherein when the drive rod moves through the first intermediate position, a force of the drive rod causes the actuator to move each of the pivotable fingers, which causes the pivotable fingers to rotate against the biasing force, and causes the lower portions of the pivotable fingers to move away from under the outer portion of the flange of the first fixing element.

18. The apparatus for inserting fixing elements according to claim 16, wherein the biasing member includes a pair of flexible fingers, each of which includes a spring strip of flexible material.

19. The apparatus for inserting fixing elements according to claim 18, wherein a first end of each of the flexible fingers is fixed, respectively, to opposite sides of the apparatus, and a second end of each of the flexible fingers applies the biasing force to the corresponding pivotably mounted finger.

20. The apparatus for inserting fixing elements according to claim 15, wherein a biasing member is provided to bias the fingers toward the side wall of the nose piece, wherein the actuator and the biasing member have axes that are parallel to each other when the fingers are in a closed position.

21. The apparatus for inserting fixing elements according to claim 11, further comprising a feed track mounted on the nose piece, the feed track being adapted to supply the fixing elements to a horizontal slot formed on the lower face of the nose piece.

22. The apparatus for inserting fixing elements according to claim 21, wherein the feed track mounted on the nose piece extends upwardly at angle of 45° or less with respect the horizontal slot.

23. The apparatus for inserting fixing elements according to claim 11, wherein the finger is a pair of flexible fingers are spring strips made of a flexible material, and upper portions of the fingers are fixed, respectively, to opposite side walls of the nose piece.

24. The apparatus for inserting fixing elements according to claim 23, wherein each of the flexible fingers is substantially L-shaped, the lower portion of the each of the L-shaped fingers extending under the outer portion of the flange of the first fixing element, and an upper portion of each of the L-shaped fingers extending upwardly from the lower portion.

25. The apparatus for inserting fixing elements according to claim 11, wherein the nose piece is connected to a feed track that is adapted to supply the fixing elements to the nose piece.

26. The apparatus for inserting fixing elements according to claim 25, wherein a horizontal slot is formed on the lower face of the nose piece, the horizontal slot being adapted to receive the first fixing element from the feed track.

27. The apparatus for inserting fixing elements according to claim 26, wherein the nose piece is provided with at least one magnet for holding the first fixing element in the horizontal slot.

28. The apparatus for inserting fixing elements according to claim 26, wherein the horizontal slot holds the first fixing element in a fixed position.

29. The apparatus for inserting fixing elements according to claim 26, wherein the lower face of the nose piece is arranged such that when the first fixing element is disposed in the horizontal slot, a part of the fixing element projects below the lower face of the nose piece, and wherein the projecting part of the first fixing element is capable of locating the predefined seat into which the first fixing element is to be inserted.

30. The apparatus for inserting fixing elements according to claim 25, wherein the feed track is mounted on the nose piece at an angle that slopes upwardly with respect to the lower face of the nose piece.

31. The apparatus for inserting fixing elements according to claim 11, further comprising a guide tube fixed to a lower side of a drive head, the nose piece being movable vertically with respect to the guide tube and the drive head by a predetermined distance.

32. The apparatus for inserting fixing elements according to claim 31, wherein the guide tube is provided with a vertical slot on a side thereof, and a stopper of the guide tube that extends into the vertical slot of the nose piece enables the nose piece to move within the predetermined distance.

33. The apparatus for inserting fixing elements according to claim 31, further the nose piece is biased in a downward direction away from an upper end of the guide tube.

34. The apparatus for inserting fixing elements according to claim 11, wherein when an operator of the apparatus places the nose piece against the work piece and applies a downward pressure on the apparatus, the nose piece is adapted to move upward toward a drive head, before the operator is able to cause the drive rod to drive the first fixing element into the seat.

35. The apparatus for inserting fixing elements according to claim 11, wherein the nose piece is fixed with respect to a drive head of the apparatus.

36. The apparatus for inserting fixing elements according to claim 11, wherein the lower face of the nose piece is integrated with a downstream portion of a feed track which supplies the first fixing element.

37. The apparatus for inserting fixing elements according to claim 36, wherein the downstream portion of the feed track extends at an angle that is parallel to the lower face of the nose piece.

38. The apparatus for inserting fixing elements according to claim 36, wherein the downstream portion of the feed track includes a horizontal slot adapted to receive the first fixing element from the feed track.

39. The apparatus for inserting fixing elements according to claim 11, further comprising:

a guide pin extending downwardly from a lower face of the drive rod, wherein the guide pin is adapted to be inserted into a barrel of the fixing element held by the finger, and stabilizing the fixing element while the fixing element is being inserted into the first predefined seat.

* * * * *